US010220628B2

(12) United States Patent
Shiota et al.

(10) Patent No.: US 10,220,628 B2
(45) Date of Patent: Mar. 5, 2019

(54) LIQUID SUPPLY UNIT

(71) Applicant: Seiko Epson Corporation, Tokyo (JP)

(72) Inventors: Takayuki Shiota, Kitakyusyu (JP); Atsushi Kobayashi, Matsumoto (JP); Tadahiro Mizutani, Shiojiri (JP); Shun Oya, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/717,654

(22) Filed: Sep. 27, 2017

(65) Prior Publication Data

US 2018/0015727 A1 Jan. 18, 2018

Related U.S. Application Data

(63) Continuation of application No. 14/573,424, filed on Dec. 17, 2014, now Pat. No. 9,844,945.

(30) Foreign Application Priority Data

Dec. 18, 2013 (JP) ..... 2013-260964
Dec. 26, 2013 (JP) ..... 2013-270007
(Continued)

(51) Int. Cl.
*B41J 2/175* (2006.01)
*B41J 2/17* (2006.01)

(52) U.S. Cl.
CPC ..... *B41J 2/1752* (2013.01); *B41J 2/175* (2013.01); *B41J 2/1714* (2013.01); *B41J 2/1753* (2013.01);
(Continued)

(58) Field of Classification Search
USPC ..... 347/85, 86, 87
See application file for complete search history.

(56) References Cited

U.S. PATENT DOCUMENTS 4,556,012 A 12/1985 Scrudato
5,182,581 A 1/1993 Kashimura et al.
(Continued)

FOREIGN PATENT DOCUMENTS

CN 1294053 A 5/2001
CN 103204005 A 7/2013
(Continued)

OTHER PUBLICATIONS

Non-Final Office Action dated Mar. 18, 2015 in U.S. Appl. No. 14/573,192.
(Continued)

*Primary Examiner* — Lam Nguyen
(74) *Attorney, Agent, or Firm* — Foley & Lardner LLP

(57) ABSTRACT

A technique of enhancing attachment of a liquid supply unit to a liquid ejection device is provided. A first ink cartridge 100*a* and a second ink cartridge 100*b* are attached to a carriage 27 of a printing device 10 via a holder structure 200. Each of the first and the second ink cartridges 100*a* and 100*b* includes a circuit substrate 130 having a plurality of terminals 151 to 159 which are electrically connected with a device-side terminal assembly 250 provided on the holder structure 200. Each of the first and the second ink cartridges 100*a* and 100*b* also includes a main engagement part 120 configured to engage with a lever member 230 of the holder structure 200 as an engaged part, such as to limit motion of the circuit substrate 130 away from the holder structure 200. The circuit substrate 130 includes a first terminal 151 and a second terminal 152 located on respective ends in an array direction of the terminals. The main engagement part 120 has a width greater than an interval between contact portions CP of the first and the second terminals 151 and 152 in the array direction of the terminals.

6 Claims, 23 Drawing Sheets

(30) Foreign Application Priority Data

| | | |
|---|---|---|
| Dec. 27, 2013 | (JP) | 2013-272477 |
| Jan. 30, 2014 | (JP) | 2014-015767 |
| Feb. 3, 2014 | (JP) | 2014-018365 |
| Feb. 19, 2014 | (JP) | 2014-029769 |
| Feb. 21, 2014 | (JP) | 2014-031192 |
| Feb. 26, 2014 | (JP) | 2014-034847 |
| Feb. 28, 2014 | (JP) | 2014-037928 |
| Feb. 28, 2014 | (JP) | 2014-037929 |
| Mar. 7, 2014 | (JP) | 2014-045198 |
| Mar. 20, 2014 | (JP) | 2014-057360 |
| Mar. 25, 2014 | (JP) | 2014-061295 |
| Mar. 25, 2014 | (JP) | 2014-061296 |
| Mar. 25, 2014 | (JP) | 2014-061297 |
| Jun. 9, 2014 | (JP) | 2014-118344 |

(52) U.S. Cl.
CPC ..... *B41J 2/17523* (2013.01); *B41J 2/17526* (2013.01); *B41J 2/17553* (2013.01)

(56) References Cited

U.S. PATENT DOCUMENTS

| | | | |
|---|---|---|---|
| 5,184,902 | A | 2/1993 | Harada et al. |
| 5,488,401 | A | 1/1996 | Mochizuki et al. |
| 5,552,861 | A | 9/1996 | Mizude et al. |
| 5,619,239 | A | 4/1997 | Kotaki et al. |
| 6,000,789 | A | 12/1999 | Takagi et al. |
| 6,059,286 | A | 5/2000 | Miyashita |
| 6,152,555 | A | 11/2000 | Nozawa et al. |
| 6,155,678 | A | 12/2000 | Komplin et al. |
| 6,170,941 | B1 | 1/2001 | Hara et al. |
| 6,250,750 | B1 | 6/2001 | Miyazawa et al. |
| 6,276,780 | B1 | 8/2001 | Carrese et al. |
| 6,302,530 | B1 | 10/2001 | Shimada et al. |
| 6,302,535 | B1 | 10/2001 | Sturgeon et al. |
| 6,375,315 | B1 | 4/2002 | Steinmetz et al. |
| 6,416,152 | B1 | 7/2002 | Matsuzaki et al. |
| 6,431,697 | B1 | 8/2002 | King et al. |
| 6,439,491 | B1 | 8/2002 | Liao |
| 6,488,369 | B1 | 12/2002 | Steinmetz et al. |
| 6,502,917 | B1 | 1/2003 | Shinada et al. |
| 6,739,708 | B2 | 5/2004 | Studer et al. |
| 6,776,479 | B2 | 8/2004 | Ardito et al. |
| 6,899,417 | B1 | 5/2005 | Shinada et al. |
| 7,066,587 | B2 | 6/2006 | Andersen et al. |
| 7,178,909 | B2 | 2/2007 | Yoshiyama et al. |
| 7,258,431 | B2 | 8/2007 | Shinada et al. |
| 7,300,142 | B1 | 11/2007 | Usui et al. |
| 7,445,320 | B2 | 11/2008 | Jung et al. |
| RE41,601 | E | 8/2010 | Matsuzaki et al. |
| 8,297,738 | B1 | 10/2012 | Kodama et al. |
| 8,297,739 | B1 | 10/2012 | Kodama et al. |
| 8,439,482 | B1 | 5/2013 | Kodama et al. |
| 8,540,347 | B2 | 9/2013 | Ishizawa et al. |
| 2001/0045977 | A1 | 11/2001 | King et al. |
| 2002/0085075 | A1 | 7/2002 | Shinada et al. |
| 2002/0118262 | A1 | 8/2002 | Seino et al. |
| 2002/0158948 | A1 | 10/2002 | Miyazawa et al. |
| 2002/0167574 | A1 | 11/2002 | Shinada et al. |
| 2002/0171700 | A1 | 11/2002 | Shinada et al. |
| 2002/0171701 | A1 | 11/2002 | Shinada et al. |
| 2002/0175977 | A1 | 11/2002 | Hanson et al. |
| 2002/0180823 | A1 | 12/2002 | Shinada et al. |
| 2003/0035035 | A1 | 2/2003 | Komplin et al. |
| 2003/0058296 | A1 | 3/2003 | Shinada et al. |
| 2003/0081088 | A1 | 5/2003 | King et al. |
| 2003/0085969 | A1 | 5/2003 | Shinada et al. |
| 2004/0246304 | A1 | 12/2004 | Takahashi et al. |
| 2004/0246317 | A1 | 12/2004 | Hayashi et al. |
| 2005/0146576 | A1 | 7/2005 | Shinada et al. |
| 2005/0168549 | A1 | 8/2005 | Shinada et al. |
| 2005/0195255 | A1 | 9/2005 | Shinada et al. |
| 2006/0023053 | A1 | 2/2006 | Sasa et al. |
| 2006/0033790 | A1 | 2/2006 | Shinada et al. |
| 2006/0066696 | A1 | 3/2006 | Matsumoto et al. |
| 2006/0119677 | A1 | 6/2006 | Shinada et al. |
| 2006/0203050 | A1 | 9/2006 | Shinada et al. |
| 2006/0290757 | A1 | 12/2006 | Shinada et al. |
| 2007/0211086 | A1 | 9/2007 | Shimomura et al. |
| 2007/0247501 | A1 | 10/2007 | Shinada et al. |
| 2008/0049080 | A1 | 2/2008 | Hayashi et al. |
| 2008/0049081 | A1 | 2/2008 | Hayashi et al. |
| 2008/0284830 | A1 | 11/2008 | Shinada et al. |
| 2009/0009560 | A1 | 1/2009 | Shinada et al. |
| 2009/0027453 | A1 | 1/2009 | Shinada et al. |
| 2009/0040274 | A1 | 2/2009 | Shinada et al. |
| 2009/0040275 | A1 | 2/2009 | Shinada et al. |
| 2009/0246317 | A1 | 10/2009 | Nakao et al. |
| 2010/0073423 | A1 | 3/2010 | Nakata et al. |
| 2011/0273520 | A1 | 11/2011 | Shinada et al. |
| 2012/0229567 | A1 | 9/2012 | Sawata et al. |
| 2013/0044152 | A1 | 2/2013 | Sawai |
| 2013/0057629 | A1 | 3/2013 | Miyamoto et al. |
| 2013/0182046 | A1 | 7/2013 | Kodama et al. |
| 2013/0182047 | A1 | 7/2013 | Nozawa et al. |
| 2013/0182048 | A1 | 7/2013 | Nozawa et al. |
| 2013/0182049 | A1 | 7/2013 | Kodama et al. |
| 2013/0182052 | A1 | 7/2013 | Matsuzaki et al. |
| 2013/0182053 | A1 | 7/2013 | Kodama et al. |
| 2014/0152746 | A1 | 6/2014 | Kodama et al. |
| 2014/0210917 | A1 | 7/2014 | Kodama et al. |
| 2014/0368585 | A1 | 12/2014 | Nozawa et al. |
| 2015/0077486 | A1 | 3/2015 | Kodama et al. |
| 2016/0129696 | A1 | 5/2016 | Nozawa et al. |
| 2016/0375688 | A1 | 12/2016 | Kodama et al. |

FOREIGN PATENT DOCUMENTS

| | | | |
|---|---|---|---|
| EP | 0 795 412 | A1 | 9/1997 |
| EP | 0 876 923 | A2 | 11/1998 |
| EP | 0 993 954 | A2 | 4/2000 |
| EP | 1 029 698 | A2 | 8/2000 |
| EP | 1 086 821 | A2 | 3/2001 |
| GB | 2 150 505 | A | 7/1985 |
| JP | 07-148936 | A | 6/1995 |
| JP | 09-011500 | A | 1/1997 |
| JP | 10-016249 | A | 1/1998 |
| JP | H10-218421 | A | 8/1998 |
| JP | 10-235890 | A | 9/1998 |
| JP | 10-278290 | A | 10/1998 |
| JP | 10-286972 | A | 10/1998 |
| JP | 2000-033707 | A | 2/2000 |
| JP | 2000-141684 | A | 5/2000 |
| JP | 2000-190522 | A | 7/2000 |
| JP | 2001-121715 | A | 5/2001 |
| JP | 2001-253087 | A | 9/2001 |
| JP | 2001-277534 | A | 10/2001 |
| JP | 3248831 | B | 11/2001 |
| JP | 2002-240813 | A | 8/2002 |
| JP | 2002-292905 | A | 10/2002 |
| JP | 2003-065798 | A | 3/2003 |
| JP | 2003-072099 | A | 3/2003 |
| JP | 2003-520713 | A | 7/2003 |
| JP | 2004-209662 | A | 7/2004 |
| JP | 2004-230704 | A | 8/2004 |
| JP | 2004-358914 | A | 12/2004 |
| JP | 2005-028883 | A | 2/2005 |
| JP | 2005-125559 | A | 5/2005 |
| JP | 2006-036483 | A | 2/2006 |
| JP | 2006-088650 | A | 4/2006 |
| JP | 2006-175885 | A | 7/2006 |
| JP | 2006-247932 | A | 9/2006 |
| JP | 2006-289770 | A | 10/2006 |
| JP | 2007-030388 | A | 2/2007 |
| JP | 2008-074090 | A | 4/2008 |
| JP | 2008-074100 | A | 4/2008 |
| JP | 2008-279783 | A | 11/2008 |
| JP | 2010-023458 | A | 2/2010 |
| JP | 2012-187792 | A | 10/2012 |

(56) References Cited

FOREIGN PATENT DOCUMENTS

| | | | |
|---|---|---|---|
| JP | 2013-141804 | A | 7/2013 |
| JP | 2013-158980 | A | 8/2013 |

OTHER PUBLICATIONS

Notice of Reasons for Rejection issued in related Japanese Patent Application No. 2013-260964, dated Sep. 12, 2017.
Notice of Reasons for Rejection issued in related Japanese Patent Application No. 2013-270007, dated Sep. 13, 2017.
Notice of Reasons for Rejection issued in related Japanese Patent Application No. 2013-272477, dated Sep. 13, 2017.

CROSS SECTIONAL VIEW TAKEN ON LINE A-A IN FIG. 4

LIQUID SUPPLY UNIT

CROSS-REFERENCE TO RELATED APPLICATIONS

This application claims priority to Japanese Patent Applications No. (JP) 2013-260964 filed on Dec. 18, 2013, JP 2013-270007 filed on Dec. 26, 2013, JP 2013-272477 filed on Dec. 27, 2013, JP 2014-015767 filed on Jan. 30, 2014, JP 2014-018365 filed on Feb. 3, 2014, JP 2014-029769 filed on Feb. 19, 2014, JP 2014-031192 filed on Feb. 21, 2014, JP 2014-034847 filed on Feb. 26, 2014, JP 2014-037928 filed on Feb. 28, 2014, JP 2014-037929 filed on Feb. 28, 2014, JP 2014-045198 filed on Mar. 7, 2014, JP 2014-057360 filed on Mar. 20, 2014, JP 2014-061295 filed on Mar. 25, 2014, JP 2014-061296 filed on Mar. 25, 2014, JP 2014-061297 filed on Mar. 25, 2014, and JP 2014-118344 filed on Jun. 9, 2014, entire disclosures of which are incorporated herein by reference for all purposes.

BACKGROUND

Technical Field

The present invention relates to a liquid supply unit configured to supply a liquid to a liquid ejection device.

Description of the Related Art

A known liquid supply unit is, for example, an ink cartridge configured to supply ink to an inkjet printer. The inkjet printer (hereinafter simply called "printer") is one type of a liquid ejection device and is provided as a printing device to eject ink droplets on a printing surface and thereby form an image. The ink cartridge is attachable to and detachable from a carriage included in the printer via a mounting mechanism. According to a technique disclosed in JP 2013-141804A, the ink cartridge is attached to the carriage by rotating operation of a lever.

SUMMARY

The ink cartridge may have a circuit substrate for transmission of electric signals to and from the printer. The printer detects the state of attachment of the ink cartridge to the carriage and obtains information regarding the ink contained in the ink cartridge through the transmission of signals via this circuit substrate. With regard to the ink cartridge, it is desired to ensure the electrical connectivity with the printer in the state that the ink cartridge is attached to the carriage of the printer.

With regard to the ink cartridge, it is also desired to enhance the fixation and the stability when the ink cartridge is attached to the carriage and to improve the space use efficiency by downsizing and simplification of the attachment mechanism. Additionally, with regard to the ink cartridge, it is desired to improve the operability during the attachment operation, for example, simplification of the attachment operation to the printer and suppression of wrong attachment.

Various studies and works have been performed, in order to enhance the attachment of the ink cartridge to the carriage. Other needs with regard to the ink cartridge include downsizing, cost reduction, easy manufacture, resource saving and improvement of usability. These problems are not limited to the ink cartridge attached to the printer but are commonly found in any of various liquid supply units which are attached to and connected with a device consuming a liquid, such as a liquid ejection device ejecting a liquid, so as to supply the liquid to the liquid-consuming device.

In order to solve at least part of the problems described above, the invention may be implemented by aspects described below.

[1] According to one aspect of the invention there is provided a liquid supply unit. The liquid supply unit may comprise a plurality of contact portions and an engagement part. The plurality of contact portions may be arrayed in an array direction to be electrically connectable with an electrode assembly of a liquid ejection device. The engagement part may be configured to be engageable with an engaged part of the liquid ejection device, such as to limit a motion of the plurality of contact portions away from the liquid ejection device. The plurality of contact portions may include a first contact portion and a second contact portion located on both ends in the array direction, and the engagement part may have a width greater than an interval between the first contact portion and the second contact portion in the array direction. The liquid supply unit of this aspect is engaged w the liquid ejection device by the engagement part having the width greater than the interval between the first contact portion and the second contact portion. This configuration enhances the electrical connectivity of the first contact portion and the second contact portion.

[2] In the liquid supply unit of the above aspect, the engagement part may have a first abutting part and a second abutting part arranged to abut against the engaged part, and an interval between the first abutting part and the second abutting part in the array direction may be wider than the interval between the first contact portion and the second contact portion in the array direction. The liquid supply unit of this aspect, touching the first abutting part and the second abutting part having the wider interval of arrangement to the engaged part, suppresses the liquid supply unit to be attached to the liquid ejection device in a state that the array direction of the first contact portion and the second contact portion is inclined.

[3] In the liquid supply unit of the above aspect, the first abutting part and the second abutting part may be arrayed across a space in the array direction in the engagement part. In the liquid supply unit of this aspect, there is a space between the first abutting part and the second abutting part. This suppresses the first abutting part and the second abutting part of the main engagement part from obliquely abutting against the engaged part. Accordingly this suppresses deterioration of the connectivity of the first contact portion and the second contact portion caused by inclination of the liquid supply unit.

[4] The liquid supply unit of the above aspect may further comprise a first detection terminal and a second detection terminal used by the liquid ejection device to detect attachment of the liquid supply unit. The first detection terminal may have the first contact portion, and the second detection terminal may have the second contact portion. The configuration of the liquid supply unit of this aspect improves the detection accuracy of the state of attachment of the liquid supply unit to the liquid ejection device.

[5] The liquid supply unit of the above aspect may further comprise: a storage unit; a data terminal configured to have a third contact portion which is electrically connectable with the liquid ejection device, located between the first detection terminal and the second detection terminal in the array direction, and provided to supply data to the storage unit; a high potential terminal configured to have a fourth contact portion which is electrically connectable with the liquid ejection device, located between the first detection terminal and the second detection terminal in the array direction, and provided to supply a high potential to the storage unit; and a low potential terminal configured to have a fifth contact portion which is electrically connectable with the liquid ejection device, located between the first detection terminal and the second detection terminal in the array direction, and provided to supply a low potential to the storage unit. The configuration of the liquid supply unit of this aspect enhances the connectivity of the respective terminals and thereby improves the communication quality between the storage unit of the liquid supply unit and the liquid ejection device.

[6] The liquid supply unit of the above aspect may further comprise: a first wall; a second wall opposed to the first wall; a third wall arranged to intersect with the first wall and the second wall; and a fourth wall arranged to intersect with the first wall and the second wall and opposed to the third wall. The engagement part, the first contact portion and the second contact portion may be located on the fourth wall. The engagement part may abut against the engaged part in a direction from the second wall toward the first wall. In a plan view of the liquid supply unit in a direction from the fourth wall toward the third wall, the first contact portion and the second contact portion may be located between the engagement part and the first wall. In the liquid supply unit of this aspect, the first contact portion and the second contact portion are located at the position to be pressed by the engagement part. This configuration enhances the electrical connectivity of the first contact portion and the second contact portion and improves the fixation of the liquid supply unit to the liquid ejection device.

[7] In the liquid supply unit of the above aspect, the engagement part may include an extended section which is extended from the second wall in a direction from the third wall toward the fourth wall. The configuration of the liquid supply unit of this aspect improves the fixation of the liquid supply unit to the liquid ejection device.

[8] The liquid supply unit of the above aspect may further comprise: a fifth wall arranged to intersect with the first wall, the second wall, the third wall and the fourth wall; and a sixth wall constructed to intersect with the first wall, the second wall, the third wall and the fourth wall and opposed to the fifth wall. In the plan view of the liquid supply unit in the direction from the fourth wall toward the third wall, a distance from the fifth wall to the engagement part may be shorter than a distance from the fifth wall to the first contact portion, and a distance from the sixth wall to the engagement part may be shorter than a distance from the sixth wall to the second contact portion. The configuration of the liquid supply unit of this aspect stabilizes the angle of the liquid supply unit attached to the liquid ejection device and enhances the electrical connectivity of the first and the second contact portions.

[9] In the liquid supply unit of the above aspect, the engagement part may have a first part, a cut and a second part arranged sequentially in a direction from the fifth wall toward the sixth wall. The engagement part may be abuttable at the first part and the second part against the liquid ejection device. In the liquid supply unit of this aspect, the engagement part has the cut. This configuration suppresses the center area of the engagement part from coming into contact with the engaged part and thereby suppresses inclination of the liquid supply unit.

[10] In the liquid supply unit of the above aspect, the engagement part may have a first convex protruded in a direction from the second wall toward the first wall. The first convex may have a first pressure surface configured to press against the engaged part of the liquid ejection device in a direction away from the engagement part in the course of attachment of the liquid supply unit to the liquid ejection device. The engagement part may be configured to be engaged with the engaged part when the engaged part moves in a direction approaching the engagement part after the first pressure surface presses against the engaged part to move the engaged part in the direction away from the engagement part, in the course of attachment of the liquid supply unit to the liquid ejection device. The configuration of the liquid supply unit of this aspect improves the operability during the attachment operation of the liquid supply unit.

[11] In the liquid supply unit of the above aspect, the engagement part may have a second convex protruded in the direction from the second wall toward the first wall. The second convex may have a second pressure surface configured to press against the engaged part of the liquid ejection device in the direction way from the engagement part in the course of attachment of the liquid supply unit to the liquid ejection device. The engagement part may be configured to be engaged with the engaged part when the engaged part moves in the direction approaching the engagement part after at least one of the first pressure surface and the second pressure surface presses against the engaged part to move the engaged part in the direction away from the engagement part. In the plan view of the liquid supply unit in the direction from the fourth wall toward the third wall, the first contact portion and the second contact portion may be located between the first convex and the second convex. The configuration of the liquid supply unit of this aspect improves the operability during the attachment operation of the liquid supply unit and additionally enhances the electrical connectivity of the first and the second contact portions.

[12] In the liquid supply unit of the above aspect, the first wall may have a liquid supply port arranged to supply a liquid to the liquid ejection device. In a plan view of the liquid supply unit in a direction from the first wall toward the second wall, a distance from center of the liquid supply port to the engagement part may be longer than a distance from the center of the liquid supply port to the first contact portion. The configuration of the liquid supply unit of this aspect enhances the connectivity of the liquid supply port with the liquid ejection device.

[13] In the liquid supply unit of the above aspect, the liquid supply port may have the center located between the first contact portion and the second contact portion in a direction from the fifth wall toward the sixth wall. The configuration of the liquid supply unit of this aspect enhances the connectivity of the first and the second contact portions, as well as the connectivity of the liquid supply port.

[14] The liquid supply unit of the above aspect may be configured to be rotated about an abutting position where the third wall abuts against the liquid ejection device, as a supporting point, so as to be attached to the liquid ejection device. The configuration of the liquid supply unit of this aspect enhances the attachment to the liquid ejection device.

All the plurality of components included in each of the aspects of the invention described above are not essential, but some components among the plurality of components may be appropriately changed, omitted or replaced with other components or part of the limitations may be deleted, in order to solve part or all of the problems described above or in order to achieve part or all of the advantageous effects described herein. In order to solve part or all of the problems described above or in order to achieve part or all of the advantageous effects described herein, part or all of the technical features included in one aspect of the invention described above may be combined with part or all of the technical features included in another aspect of the invention described later to provide still another independent aspect of the invention.

The invention is applicable to any of various aspects other than the liquid supply unit, for example, a device equipped with the liquid supply unit, a system including such a device, an attachment mechanism, an attachment structure or an attachment method of the liquid supply unit.

DESCRIPTION OF EMBODIMENTS

A. First Embodiment

[Configuration of Printing Device]

Figure 1:
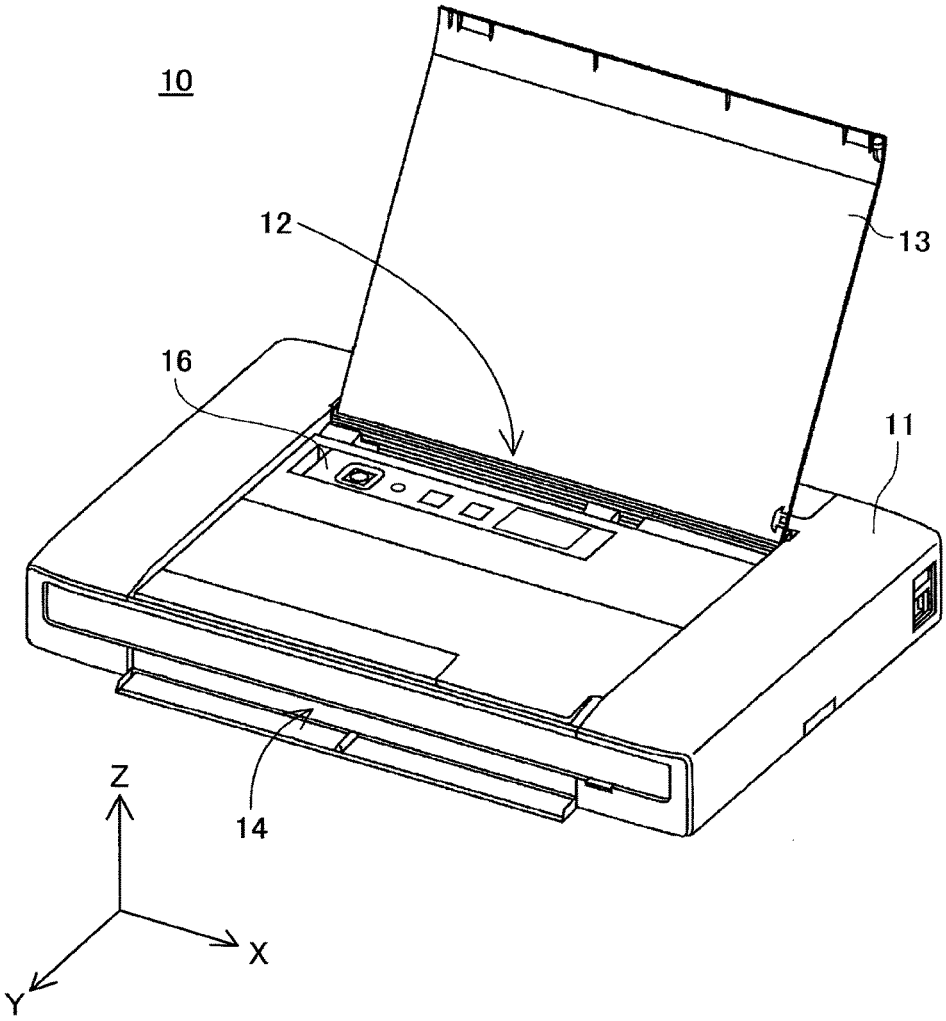
FIG. 1 is a schematic perspective view illustrating the appearance configuration of a printing device.
Figure 2:
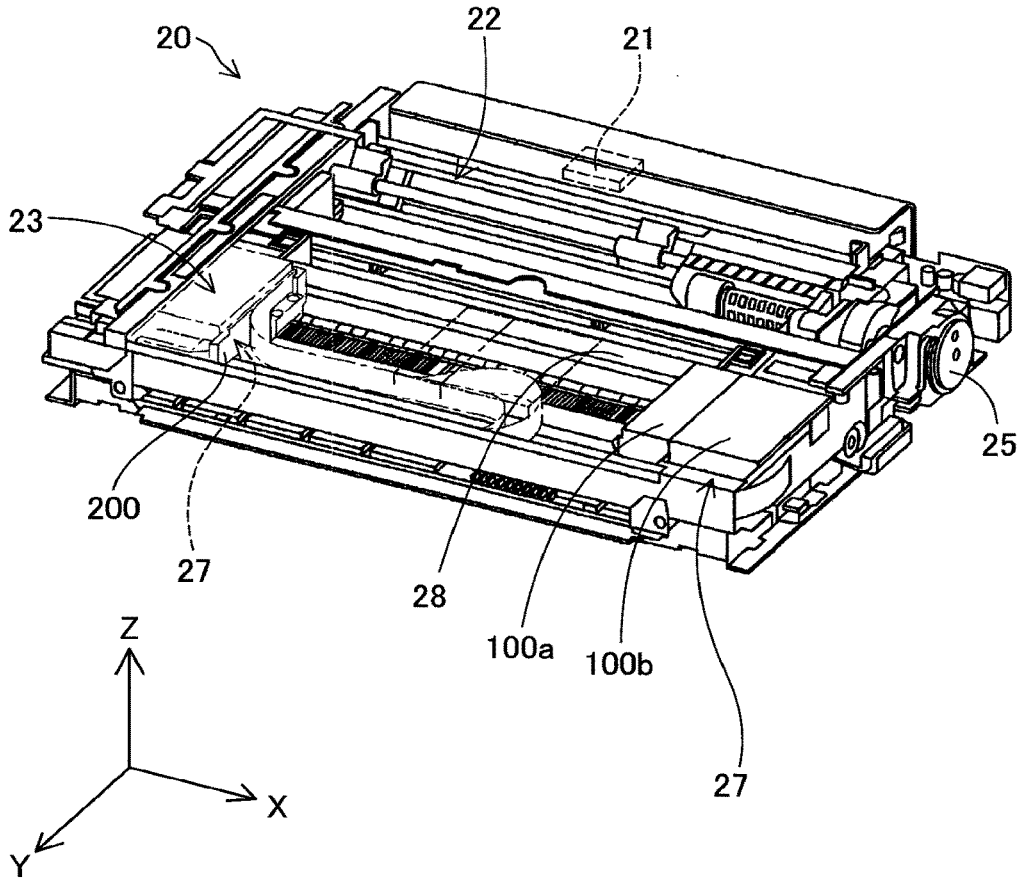
FIG. 2 is a schematic perspective view illustrating the appearance configuration of a main unit of the printing device.

FIG. 1 is a schematic perspective view illustrating the appearance configuration of a printing device 10 which an ink cartridge according to a first embodiment of the invention is attached to. Arrows X, Y and Z representing three different directions orthogonal to one another are illustrated in FIG. 1. The arrow X denotes a left-right direction parallel to a lateral direction (width direction) of the printing device 10 and shows a direction from left to right in the state facing the printing device 10. The arrow Y denotes a direction parallel to a front-back direction of the printing device 10 and shows a direction from backside (rear side) toward foreside (front side). The arrow Z denotes a height direction of the printing device 10 and shows a vertically upward direction relative to a mounting surface where the printing device 10 is placed. In other drawings used for the description herein, the arrows X, Y and Z corresponding to those of FIGS. 1 and 2 are illustrated as needed basis. In the description herein, "upper" or "up" and "lower" or "down" imply directions on the basis of the direction of the arrow Z of the printing device 10. Similarly, "front" and "back" or "rear" imply directions on the basis of the direction of the arrow Y of the printing device 10, and "left" and "right" imply directions respectively on the basis of the direction of the arrow X of the printing device 10.

The printing device 10 is an inkjet printer as one aspect of a liquid ejection device. The printing device 10 forms an image by ejection of ink droplets on printing paper according to externally supplied print data. The printing device 10 includes a casing 11, a paper feed slot 12, an upper surface cover 13, a paper output slot 14 and an operation unit 16. The casing 11 is an exterior member configured to receive a main unit (described later) with a printing mechanism of the printing device 10 placed therein. The paper feed slot 12 is an opening provided on a rear side of the casing 11 to be open upward. The printing paper as a printing medium is fed through the paper feed slot 12 to the main unit inside of the casing 11.

The upper surface cover 13 is a plate member located near the paper feed slot 12 and mounted on the casing 11 to be rotatable. The upper surface cover 13 serves as a guide plate to guide the printing paper into the paper feed slot 12 in the open state (illustrated state) and serves as a cover member to cover and protect the center area of the upper surface of the casing 11 in the closed state. The paper output slot 14 is an opening provided on the front surface of the casing 11. The printing paper fed through the paper feed slot 12 into the casing 11 is discharged to outside via the paper output slot 14. The operation unit 16 has buttons configured to be operable by the user and a display configured to display information to the user. The operation unit 16 is provided on the upper surface of the casing 11. The operation unit 16 is accessible by the user when the upper surface cover 13 is in the open state.

FIG. 2 is a schematic perspective view illustrating the appearance configuration of a main unit 20 taken out of the casing 11 of the printing device 10. The locus of the move of the carriage 27 is schematically illustrated by the broken line in FIG. 2. The main unit 20 includes a controller 21, a conveyance mechanism 22 and a printing unit 23. The controller 21 is made by a microcomputer including a central processing unit and a main storage unit. The controller 21 controls the respective components of the printing device 10 in response to the user's operation of the operation unit 16 or instructions from an external computer to perform a printing operation. The conveyance mechanism 22 conveys the printing paper introduced through the paper feed slot 12 as shown in FIG. 1 to the paper output slot 14 by rotating and driving a feed roller 25 via a conveyance path not shown in Figures extended in the direction of the arrow Y (sub-scan direction) inside of the main unit 20.

The printing unit 23 is located on the conveyance path of the printing paper and performs printing on the printing paper conveyed by the conveyance mechanism 22. The printing unit 23 has a carriage 27 and a guide rail 28. The carriage 27 has a print head (not shown) configured to eject ink droplets. While the carriage 27 moves back and forth along the guide rail 28 extended in a main scan direction (direction of the arrow X) under control of the controller 21, the carriage 27 ejects ink droplets onto the sheet surface of the printing paper conveyed in the sub-scan direction by the conveyance mechanism 22. The printing device 10 of the embodiment is an on-carriage type and has two ink cartridges 100*a* and 100*b* detachably attached to the carriage 27 via a holder structure 200.

Figure 3:
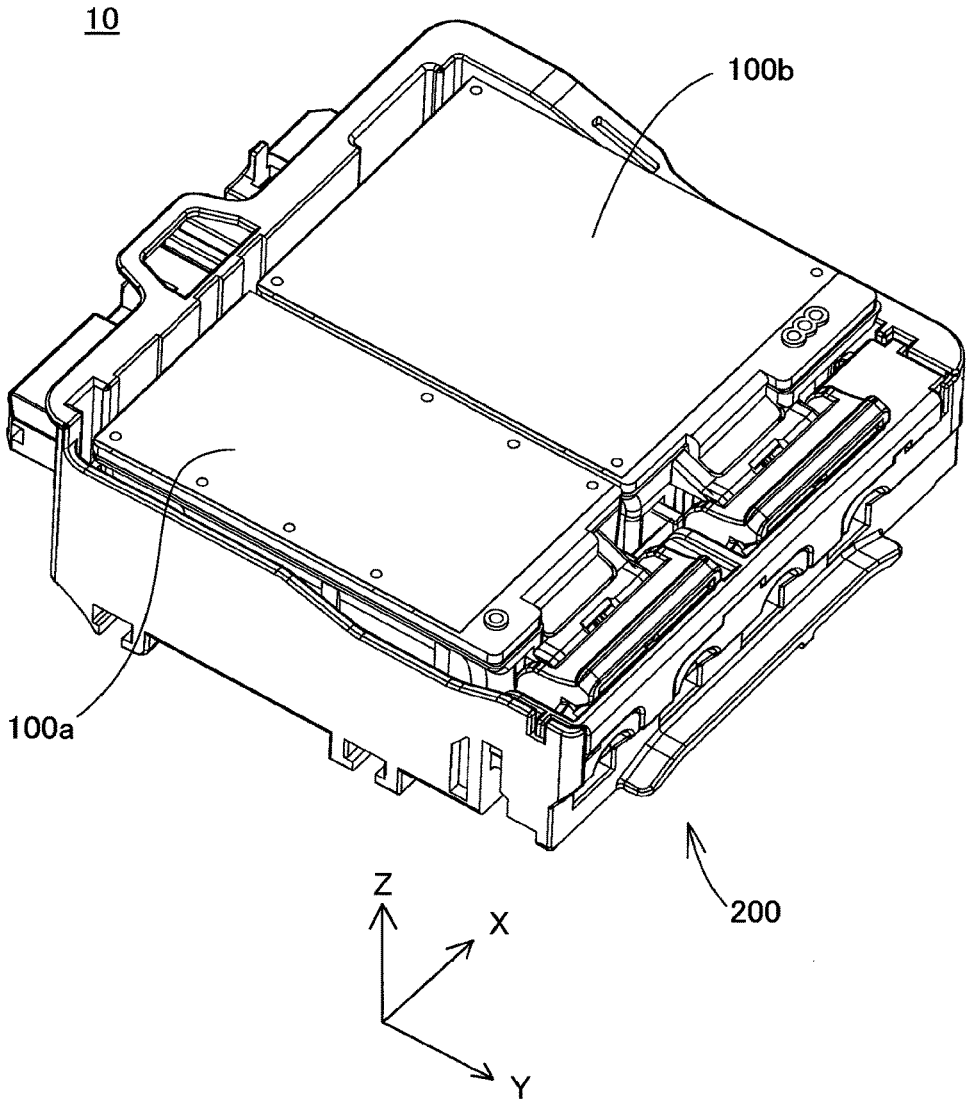
FIG. 3 is a schematic perspective view illustrating first and second ink cartridges attached to a holder structure.

FIG. 3 is a schematic perspective view illustrating the first ink cartridge 100*a* and the second ink cartridge 100*b* attached to the holder structure 200 in the printing device 10. The first ink cartridge 100*a* and the second ink cartridge 100*b* correspond to the liquid supply unit and are respectively configured to contain ink to be supplied to the printing device 10. The first ink cartridge 100*a* is configured to contain a single type of color ink, and the second ink cartridge 100*b* is configured to contain a plurality of different types of color inks. According to this embodiment, the first ink cartridge 100*a* contains black color ink, and the second ink cartridge 100*b* contains cyan, yellow and magenta color inks.

Each of the first and the second ink cartridges 100*a* and 100*b* is formed in an approximately rectangular parallelepiped shape. The first ink cartridge 100*a* has length (length in the direction of the arrow Y) and height (length in the direction of the arrow Z) substantially similar to those of the second ink cartridge 100*b*. The holder structure 200 is provided as an approximately rectangular parallelepiped box-like member having an upper opening. The first and the second ink cartridges 100*a* and 100*b* are placed in parallel in the inner space of the holder structure 200 in the state that their lengths and heights are substantially the same. In the state attached to the holder structure 200, the first and the second ink cartridges 100*a* and 100*b* have their side surfaces and bottom surfaces substantially covered and their upper surfaces entirely exposed upward.

The first and the second ink cartridges 100*a* and 100*b* are fixed to the holder structure 200 independently from each other. The following describes the detailed structures of the first and the second ink cartridges 100*a* and 100*b* and the detailed configuration of the holder structure 200 and subsequently describes the mechanism of attachment and fixation of the first and the second ink cartridges 100*a* and 100*b* to the holder structure 200. The directions of the arrows X, Y and Z shown in the drawings illustrating the first and the second ink cartridges 100*a* and 100*b* denote the directions in the state attached to the printing device 10 described above.

[Structure of First Ink Cartridge]

Figure 4:
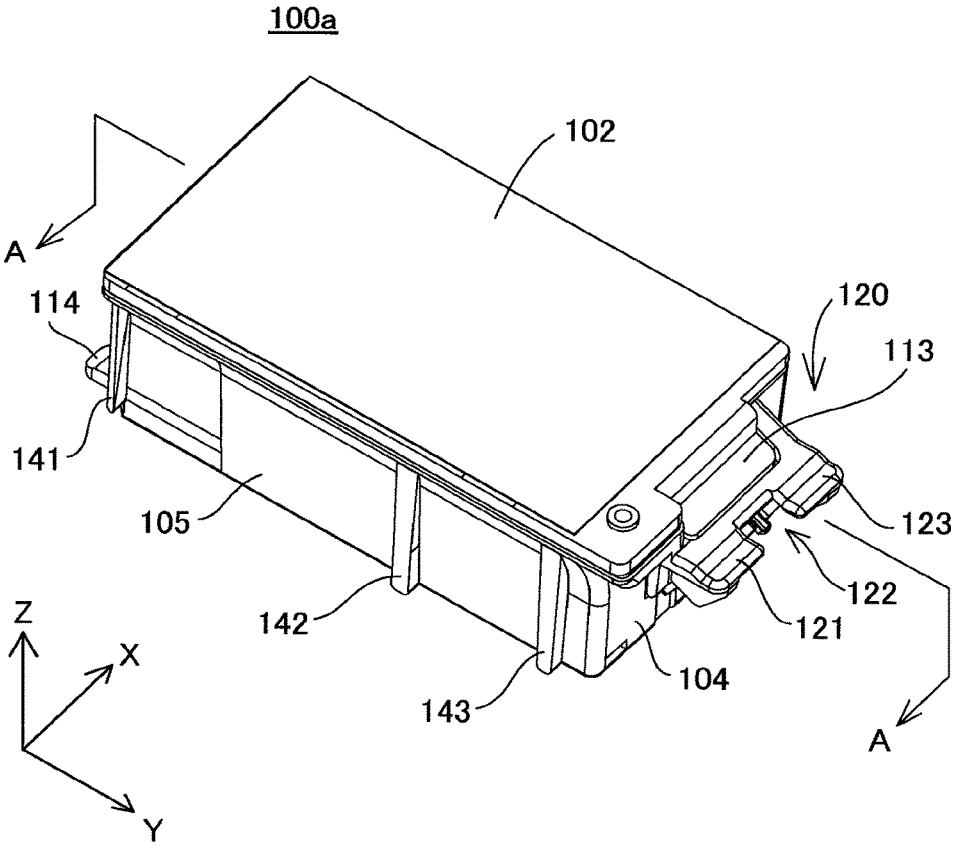
FIG. 4 is a perspective top view illustrating the appearance configuration of the first ink cartridge.
Figure 5:
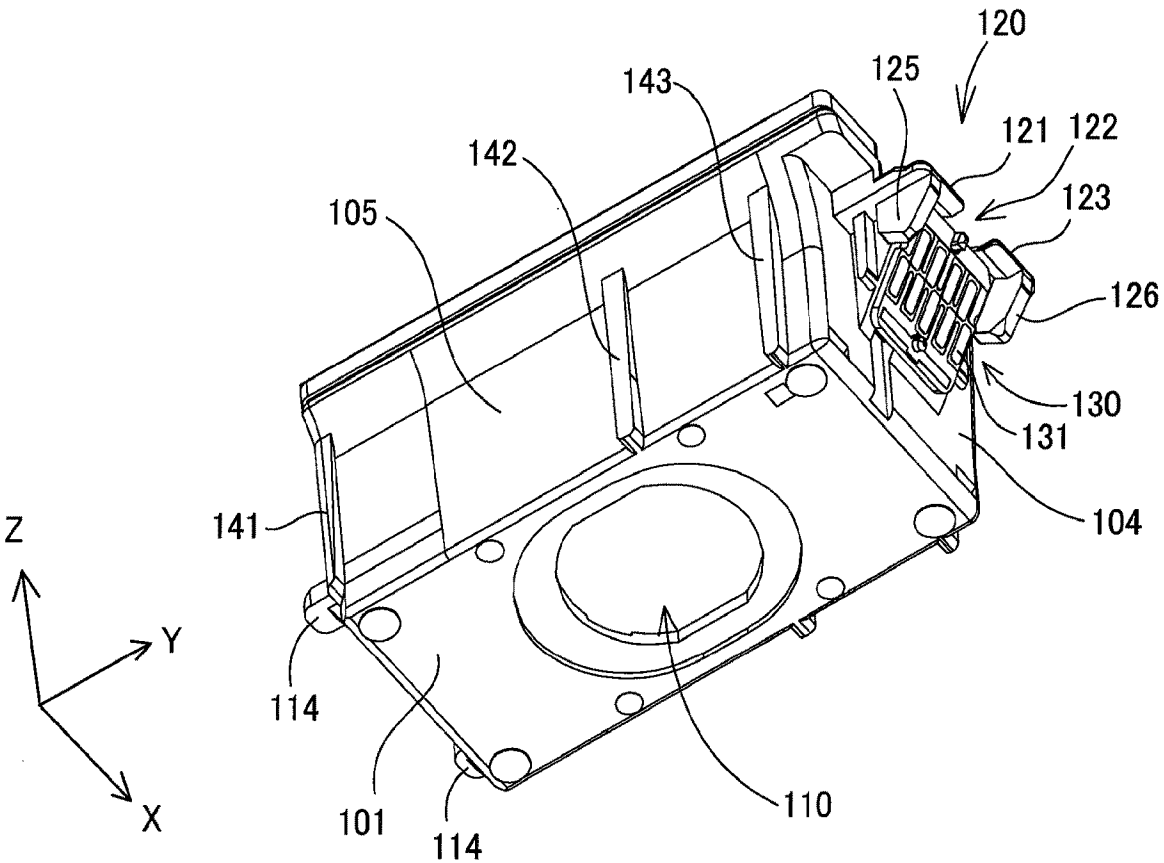
FIG. 5 is a perspective bottom view illustrating the appearance configuration of the first ink cartridge.
Figure 6:
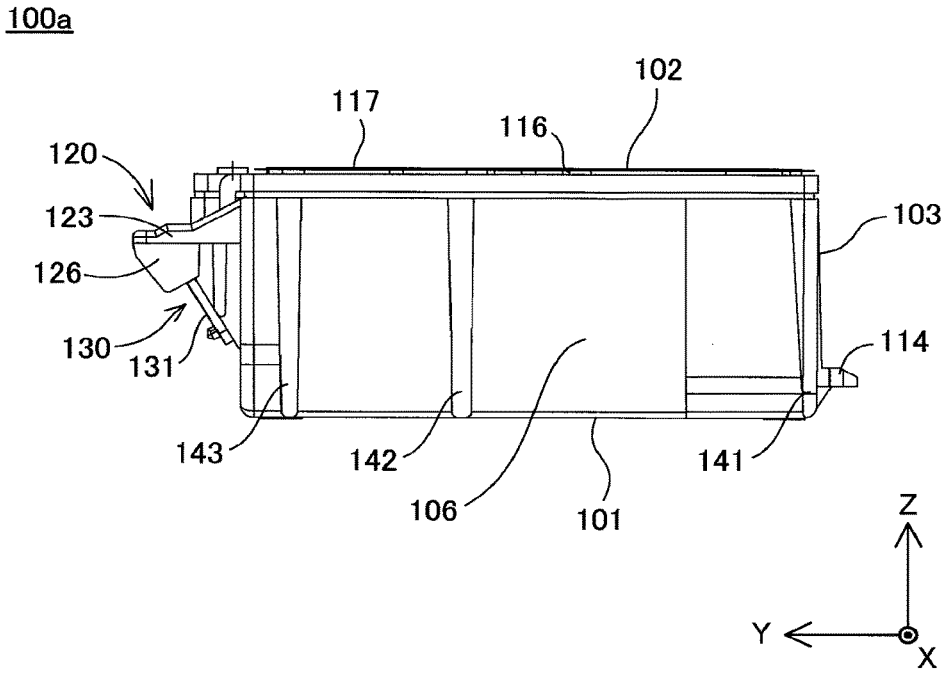
FIG. 6 is a side view illustrating the appearance configuration of the first ink cartridge.
Figure 7:
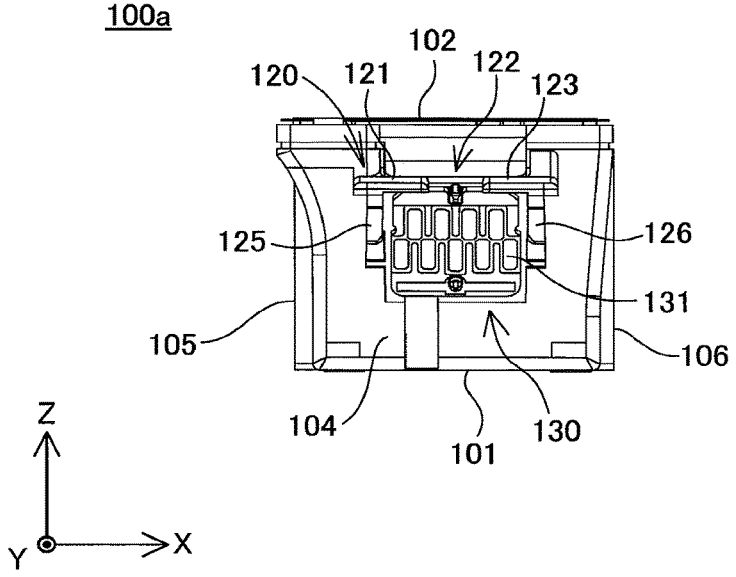
FIG. 7 is a front view illustrating the appearance configuration of the first ink cartridge.
Figure 8:
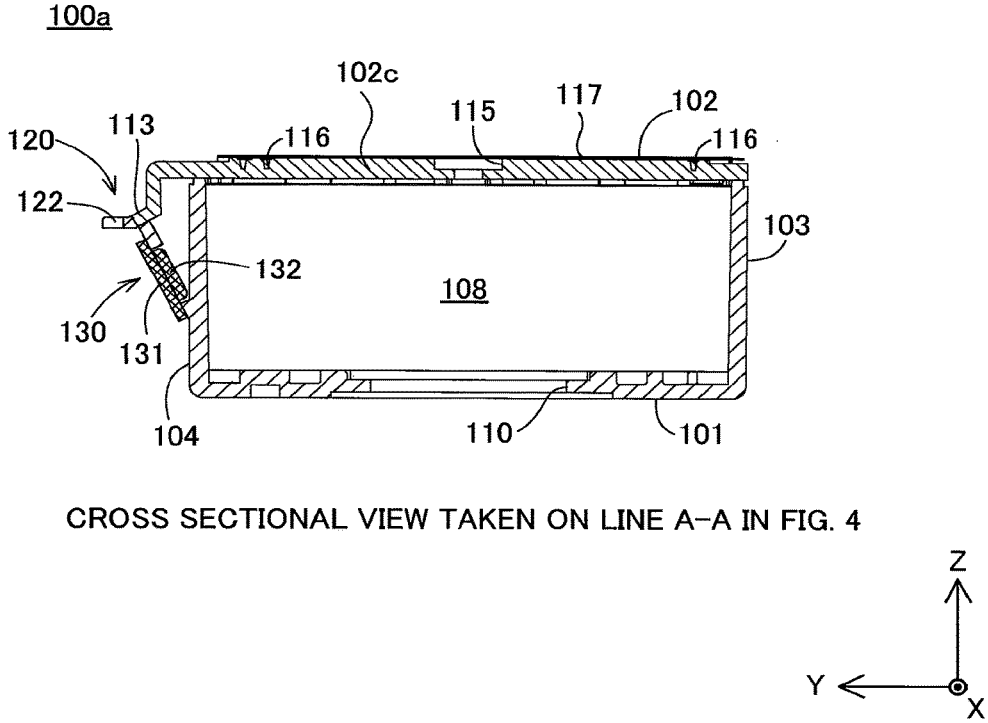
FIG. 8 is a schematic cross sectional view illustrating the first ink cartridge.

The detailed structure of the first ink cartridge 100*a* is described with reference to FIGS. 4 to 8. FIG. 4 is a perspective top view illustrating the first ink cartridge 100*a*. FIG. 5 is a perspective bottom view illustrating the first ink cartridge 100*a*. FIG. 6 is a side view illustrating the first ink cartridge 100*a*. FIG. 7 is a front view illustrating the first ink cartridge 100*a*. FIG. 8 is a schematic cross sectional view illustrating the first ink cartridge 100*a*, taken on a line A-A in FIG. 4. The detailed internal structure of an ink chamber 108 is omitted from the illustration of FIG. 8.

The first ink cartridge 100*a* is formed in an approximately rectangular parallelepiped shape as described above and has six walls 101 to 106 arranged to surround an ink chamber 108 as shown in FIG. 8 configured to contain ink. The first wall 101 as shown in FIG. 5 forms a bottom surface of the first ink cartridge 100*a*. The bottom surface herein denotes a surface facing in a direction opposite to the direction of the arrow Z in the state of attachment of the first ink cartridge 100*a* to the printing device 10. An ink supply port 110 communicating with the ink chamber 108 is provided on the center of the first wall 101. The ink supply port 110 is connected with an ink receiving part (described later) of the holder structure 200 in the state of attachment of the first ink cartridge 100*a* to the holder structure 200.

The second wall 102 as shown in FIG. 4 is opposed to the first wall 101 and forms a top surface of the first ink cartridge 100*a*. The top surface herein denotes a surface facing in the direction of the arrow Z in the state of attachment of the first ink cartridge 100*a* to the printing device 10. The second wall 102 is formed by a cover member 102*c* as shown in FIG. 8 configured to be separable from the main body of the first ink cartridge 100*a*.

The second wall 102 has an extended section 113 located on the center of an edge adjacent to the fourth wall 104 to be extended in the direction of the arrow Y. In the description herein, the term "extending" means continuously extending without intermission. The extended section 113 forms part of a main engagement part 120. The second wall 102 also has a through hole 115 through which the ink chamber 108 is filled with ink, an air flow groove 116 arranged to introduce the outside air into the ink chamber 108 and a film-like seal member 117 placed to seal the through hole 115 and the air flow groove 116 as shown in FIG. 8.

The third wall 103 as shown in FIG. 6 is arranged to intersect with the first wall 101 and the second wall 102. The third wall 103 forms a rear surface of the first ink cartridge 100*a* and is arranged to face backward of the printing device 10 in the direction opposite to the direction of the arrow Y in the state of attachment of the first ink cartridge 100*a* to the holder structure 200. The third wall 103 has a plurality of projections 114 at its lower end to be protruded in the direction of the arrow Y. The plurality of projections 114 are placed at both ends in the direction of the arrow X. The plurality of projections 114 are inserted in and engaged with fitting holes (described later) of the holder structure 200 in the course of attachment of the first ink cartridge 100*a* to the holder structure 200.

The fourth wall 104 is arranged to intersect with the first wall 101 and the second wall 102 and to be opposed to the third wall 103 as shown in FIGS. 4 to 8. The fourth wall 104 forms a front surface of the first ink cartridge 100*a* and is arranged to face forward of the printing device 10 in the direction of the arrow Y and face the user in the state of attachment of the first ink cartridge 100*a* to the holder structure 200. The fourth wall 104 has the main engagement part 120 which is to be engaged with a lever member (described later) of the holder structure 200. In the description hereof, the term "engaging" means that engaging at a predetermined location to limit the moving direction. The main engagement part 120 is located at a position closer to the upper edge on the fourth wall 104 and is arranged on the approximate center in the direction of the arrow X.

The main engagement part 120 is formed as a tongue-shaped brim extended forward and slightly downward from the second wall 102. The main engagement part 120 has a cut 122 on the center of its front edge as a local recess, such that the front edge of the main engagement part 120 is divided into two separate parts by the recessed space of the cut 122. In other words, the front edge of the main engagement part 120 is configured to have a first brim section 121 as a first section, the cut 122, a second brim section 123 as a second section arranged sequentially in the direction of the arrow X. The first brim section 121 and the second brim section 123 respectively correspond to the first abutting part and the second abutting part and have respective upper surfaces to come into surface contact with the lever member of the holder structure 200 in the course of engagement with the lever member of the holder structure 200.

A first side wall portion 125 and a second side wall portion 126 are provided on the respective lower surfaces of the first brim section 121 and the second brim section 123 to be protruded and suspended downward in parallel to each other. The first side wall portion 125 and the second side wall portion 126 respectively serve as a first convex and a second convex configured to press and rotate the lever member of the holder structure 200 in the course of attachment of the first ink cartridge 100*a* to the holder structure 200. Detailed description of this mechanism is described later. The first side wall portion 125 and the second side wall portion 126 also serve as protective elements of a circuit substrate 130 described below.

The circuit substrate 130 is placed below the main engagement part 120 on the fourth wall 104 to transmit electrical signals to and from the printing device 10 as shown in FIG. 5. The circuit substrate 130 is fixed to the fourth wall 104 to face its surface slightly downward at an inclination angle of, for example, 10 to 45 degrees relative to the direction of the arrow Z.

The circuit substrate 130 includes a terminal assembly 131 and a storage unit 132 as shown in FIG. 8. The terminal assembly 131 is provided on the surface of the circuit substrate 130 and has a plurality of terminals arrayed in a specified array direction. In the state that the first ink cartridge 100*a* is attached to the holder structure 200, each of the terminals on the terminal assembly 131 comes into contact with and is electrically connected with corresponding one terminal (described later) of a plurality of terminals provided on the holder structure 200. The array configuration of the plurality of terminals included in the terminal assembly 131 of the circuit substrate 130 will be described later. The storage unit 132 is made by, for example, a rewritable nonvolatile memory, such as flash ROM. The storage unit 132 stores information regarding ink, for example, the color and the remaining quantity of ink contained in the first ink cartridge 100*a* in non-transitory manner.

The printing device 10 detects attachment of the first ink cartridge 100*a* by causing each of some terminals of the terminal assembly 131 of the circuit substrate 130 to come into contact with and to be electrically connected with corresponding one terminal of the plurality of terminals provided on the holder structure 200. The printing device 10 also obtains the information regarding the ink from the storage unit 132 of the circuit substrate 130.

According to this embodiment, the circuit substrate 130 is located between the first side wall portion 125 and the second side wall portion 126 of the main engagement part 120 as shown in FIGS. 5 and 7. The first side wall portion 125 and the second side wall portion 126 are protruded forward from the surface of the circuit substrate 130 on both sides of the circuit substrate 130. Protrusion of the first side wall portion 125 and the second side wall portion 126 on both sides of the circuit substrate 130 suppresses the user from accidentally touching the terminals on the circuit substrate 130 and thereby protects the terminals of the terminal assembly 131.

The fifth wall 105 and the sixth wall 106 are arranged to intersect with the first wall 101, the second wall 102, the third wall 103 and the fourth wall 104 and to be opposed to each other as shown in FIGS. 4 to 7. The fifth wall 105 and the sixth wall 106 form side surfaces of the first ink cartridge 100*a*. Each of the fifth wall 105 and the sixth wall 106 has ribs 141, 142 and 143 on its surface to be extended in the direction of the arrow Z. The first rib 141 is provided on a rear end of the side surface, the second rib 142 is provided at a middle position in the front-back direction of the side surface, and the third rib 143 is provided on a front end of the side surface.

The respective ribs 141, 142 and 143 work as reinforcing elements for the side wall surfaces of the first ink cartridge 100*a*. In the course of attachment of the first ink cartridge 100*a* to the holder structure 200, the ribs 141, 142 and 143 serve as guide elements to define the moving direction of the first ink cartridge 100*a* and as positioning elements to fix the position of the first ink cartridge 100*a*. Detailed description of these functions of the ribs 141, 142 and 143 is described later.

Figure 9:
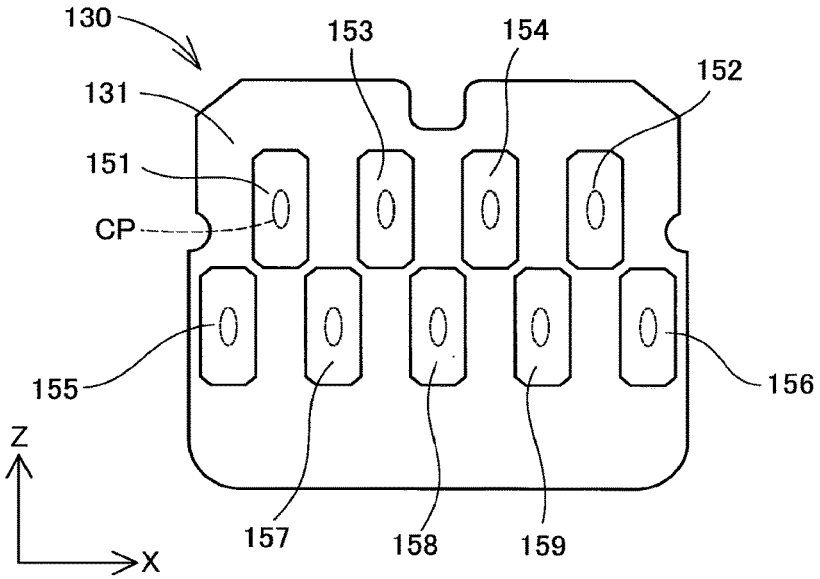
FIG. 9 is a schematic diagram illustrating an array configuration of a plurality of terminals on a circuit substrate.

FIG. 9 is a schematic diagram illustrating an array configuration of a plurality of terminals 151 to 159 on the circuit substrate 130. The positions of contact portions CP of the respective terminals 151 to 159 are shown by broken lines in FIG. 9. Each of the plurality of terminals 151 to 159 has a contact portion CP. Each of the contact portions CP of the respective terminals 151 to 159 comes into contact with and is electrically connected with corresponding one of the terminals provided on the holder structure 200. The contact portions CP of the plurality of terminals 151 to 159 are arrayed in two lines, i.e., an upper line and a lower line, on the circuit substrate 130 and are arranged in an array direction parallel to the direction of the arrow X. The contact portions CP of the first and the second terminals 151 and 152 are located on the respective ends in the upper line. The contact portions CP of the third and the fourth terminals 153 and 154 are aligned in the direction of the arrow X between the contact portions CP of the first terminal 151 and the second terminal 152. The contact portions CP of the fifth and the sixth terminals 155 and 156 are located on the respective ends in the lower line. The contact portions CP of the seventh, the eighth and the ninth terminals 157, 158 and 159 are aligned in the direction of the arrow X between the contact portion CP of the fifth terminal 155 and the sixth terminal 156.

The first terminal 151 and the second terminal 152 respectively correspond to the first detection terminal having the first contact portion and the second detection terminal having the second contact portion and are used by the printing device 10 to detect attachment of the first ink cartridge 100*a* to the holder structure 200. The first terminal 151 and the second terminal 152 are configured to have a specified voltage change when the first ink cartridge 100*a* is adequately attached to the holder structure 200 to bring the first terminal 151 and the second terminal 152 into contact with corresponding terminals of the holder structure 200. More specifically, the first terminal 151 and the second terminal 152 are short-circuited from each other and are arranged such that the second terminal 152 has a voltage change based on the voltage applied to the first terminal 151 when the first ink cartridge 100*a* is attached to the holder structure 200.

In the circuit substrate 130 of this embodiment, the contact portions CP of the first and the second terminals 151 and 152 are placed on the respective ends in the array direction having the less number of the contact portions CP of adjacent terminals. This arrangement suppresses the occurrence of a short circuit with the contact portion CP of another terminal. The contact portions CP of the first and the second terminals 151 and 152 are arranged to be away from each other in the direction of the arrow X. This arrangement suppresses misdetection of attachment of the first ink cartridge 100*a* inclined relative to the direction of the arrow X as the correct attachment state. As described above, the circuit substrate 130 of the embodiment is configured to enhance the detection accuracy of the attachment state of the first ink cartridge 100*a* to the holder structure 200.

The third terminal 153 is a ground terminal which is grounded when the contact portion CP of the third terminal 153 comes into contact with a corresponding terminal of the holder structure 200 and corresponds to a low potential terminal configured to supply a low potential to the storage unit 132. The fourth terminal 154 is a power terminal which a high potential is applied to when the contact portion CP of the fourth terminal 154 comes into contact with a corresponding terminal of the holder structure 200 and corresponds to a high potential terminal configured to supply a high potential to the storage unit 132.

Like the first and the second terminals 151 and 152, the fifth terminal 155 and the sixth terminal 156 are used by the printing device 10 to detect attachment of the first ink cartridge 100*a* to the holder structure 200. The seventh terminal 157 is a reset terminal configured to supply a reset signal from the printing device 10 to the storage unit 132. The eighth terminal 158 is a clock terminal configured to supply a clock signal from the printing device 10 to the storage unit 132. The ninth terminal 159 is a data terminal configured to send and receive a data signal between the storage unit 132 and the printing device 10. According to this embodiment, the printing device 10 sends and receives data to and from the storage unit 132 by serial transfer via the ninth terminal 159, in response to the clock signal supplied via the eighth terminal 158.

[Structure of Second Ink Cartridge]

Figure 10:
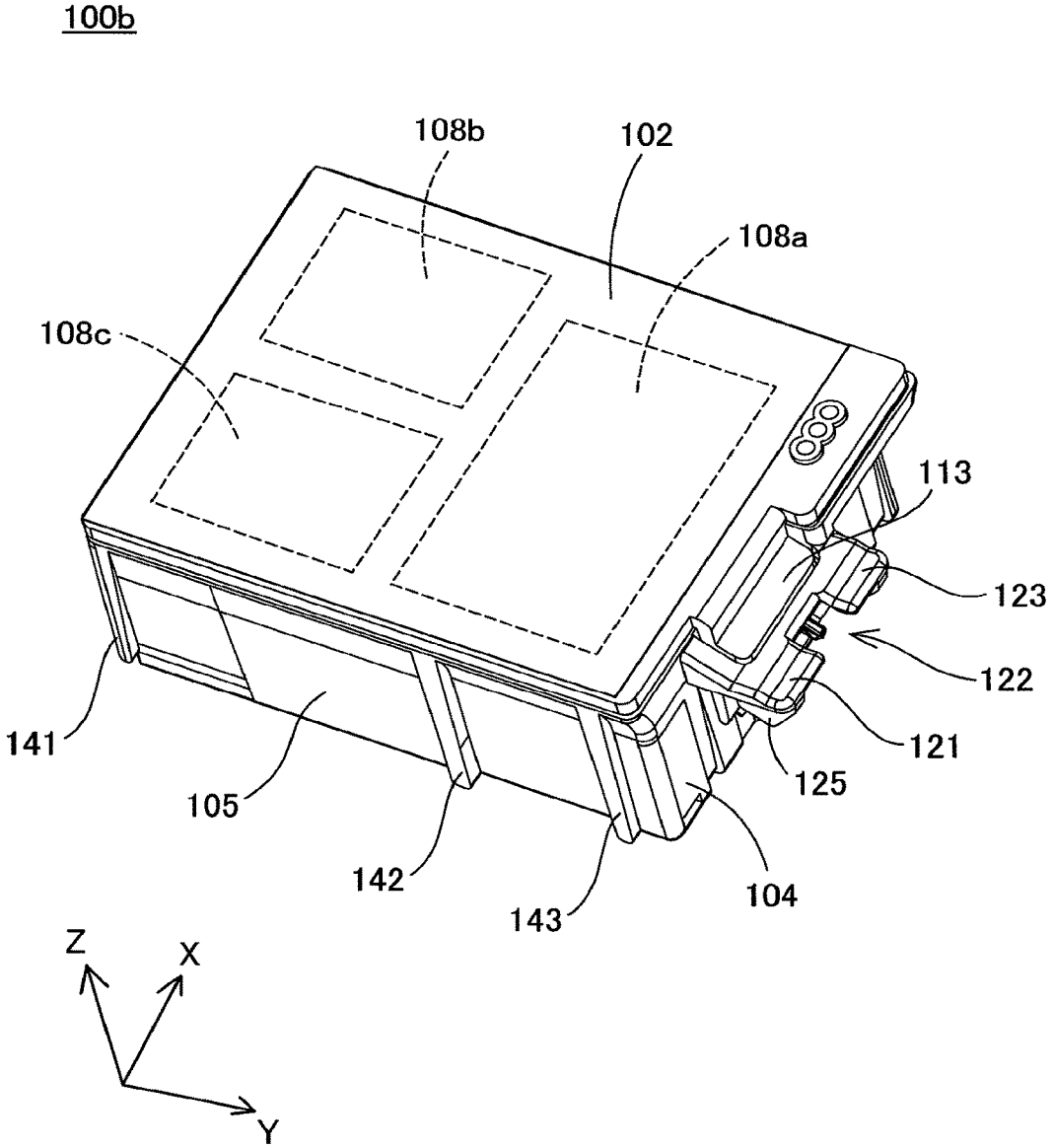
FIG. 10 is a perspective top view illustrating the second ink cartridge.
Figure 11:
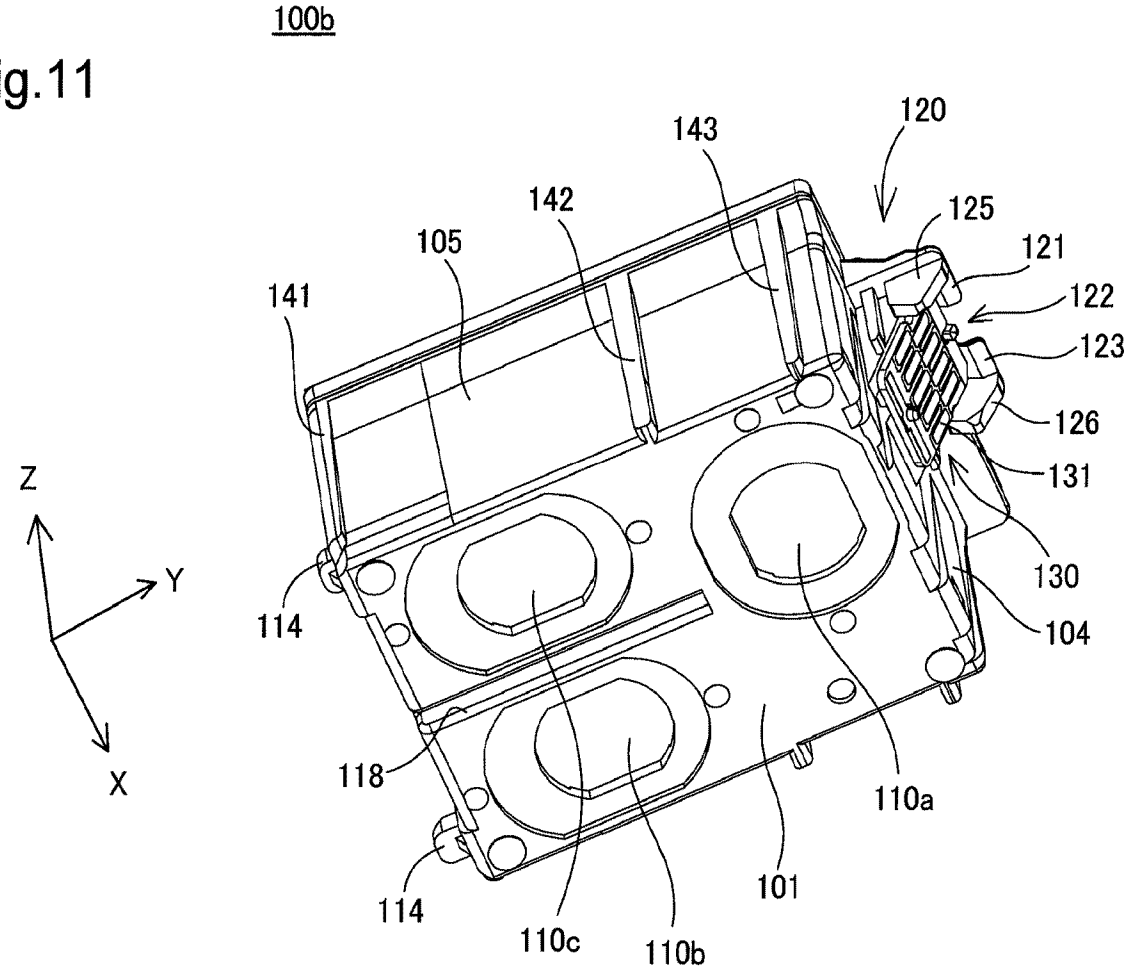
FIG. 11 is a perspective bottom view illustrating the second ink cartridge.
Figure 12:
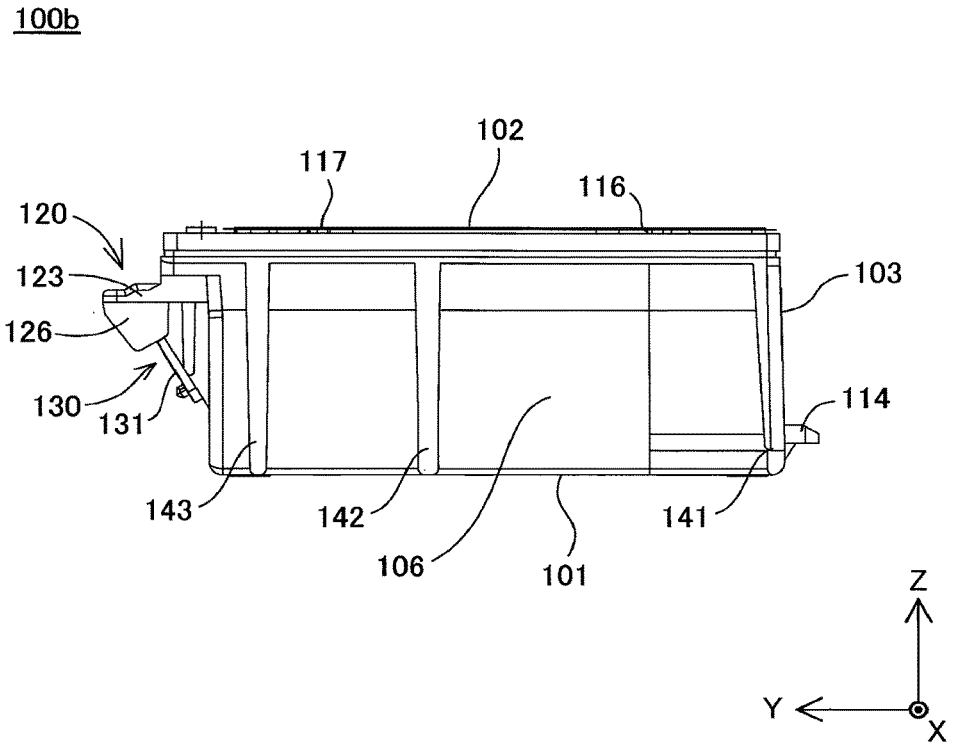
FIG. 12 is a side view illustrating the second ink cartridge.
Figure 13:
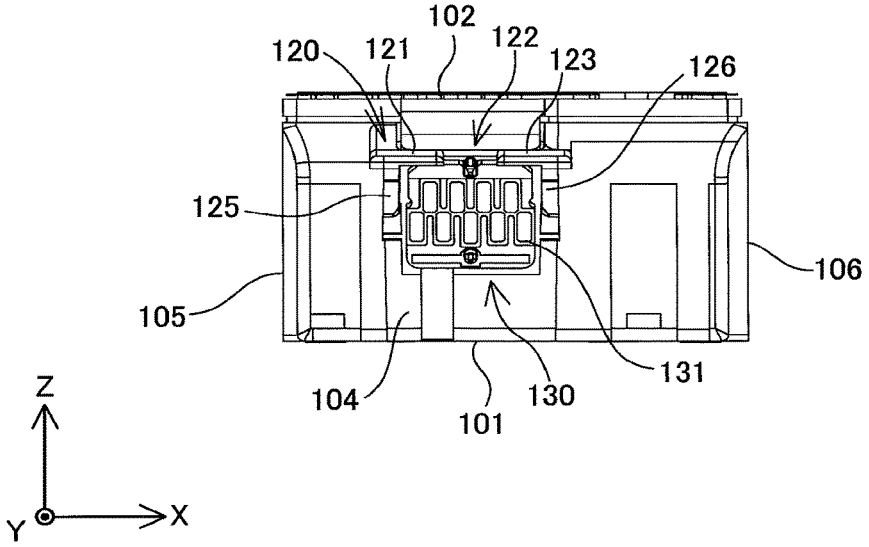
FIG. 13 is a front view illustrating the second ink cartridge.

The detailed structure of the second ink cartridge 100*b* is described with reference to FIGS. 10 to 13. FIG. 10 is a perspective top view illustrating the second ink cartridge 100*b*. As a matter of convenience, ink chambers 108*a* to 108*c* formed inside of the second ink cartridge 100*b* are illustrated by the broken line in FIG. 10. FIG. 11 is a perspective bottom view illustrating the second ink cartridge 100*b*. FIG. 12 is a side view illustrating the second ink cartridge 100*b*. FIG. 13 is a front view illustrating the second ink cartridge 100*b*. In FIGS. 10 to 13, the like components to those of the first ink cartridge 100*a* described above with reference to FIGS. 4 to 8 are expressed by the like numerical symbols.

The second ink cartridge 100*b* has the appearance in an approximately rectangular parallelepiped shape as described above and has six walls 101 to 106 corresponding to the walls 101 to 106 of the first ink cartridge 100*a*. The inside of the second ink cartridge 100*b* is parted into three ink chambers 108*a* to 108*c* configured to separately contain three different color inks.

The first ink chamber 108*a* is formed in a front area facing the fourth wall 104. The second and the third ink chambers 108*b* and 108*c* are formed by dividing an area behind the first ink chamber 108*a* into two parts in the direction of the arrow X. The second ink chamber 108*b* is formed on the side facing the fifth wall 105, and the third ink chamber 108*c* is formed on the side facing the sixth wall 106.

The first wall 101 as shown in FIG. 11 has three ink supply ports 110*a* to 110*c* formed corresponding to the respective ink chambers 108*a* to 108*c*. The first ink supply port 110*a* is formed to have its center at a position substantially aligned with the center in the direction of the arrow X of the main engagement part 120 provided on the fourth wall 104. The second ink supply port 110*b* and the third ink supply port 110*c* are formed on the respective centers of the second ink chamber 108*b* and the third ink chamber 108*c*.

A groove 118 extended linearly in the direction of the arrow Y is formed between the second and the third ink supply ports 110*b* and 110*c* at a position corresponding to the boundary between the second and the third ink chambers 108*b* and 108*c*. The groove 118 serves as an engaged part to be engaged with a second sub-wall member (described later) of the holder structure 200 when the second ink cartridge 100*b* is attached to the holder structure 200.

The second wall 102 as shown in FIG. 10 has substantially similar structure to that of the second wall 102 of the first ink cartridge 100*a*, except a different width in the direction of the arrow X and a different location where an extended section 113 is formed. In the second ink cartridge 100*b*, the extended section 113 is formed at a position shifted from the center in the direction opposite to the direction of the arrow X at the edge adjacent to the fourth wall 104. The third wall 103 as shown in FIG. 12 has substantially similar structure to that of the third wall 103 of the first ink cartridge 100*a*, except a different width in the direction of the arrow X.

The fourth wall 104 as shown in FIGS. 10 and 11 has substantially similar structure to that of the fourth wall 104 of the first ink cartridge 100*a*, except a different location where a main engagement part 120 is formed. In the second ink cartridge 100*b*, the main engagement part 120 is formed at a position shifted from the center in the direction opposite to the direction of the arrow X at the edge adjacent to the second wall 102. This configuration causes the respective main engagement parts 120 to be arranged adjacent to and close to each other when the first and the second ink cartridges 100*a* and 100*b* are attached to the holder structure 200 as shown in FIG. 3. The fifth wall 105 as shown in FIGS. 10 and 11 and the sixth wall 106 as shown in FIG. 12 respectively have substantially similar structures to those of the fifth wall 105 and the sixth wall 106 of the first ink cartridge 100*a*.

[Configuration of Holder Structure]

Figure 14:
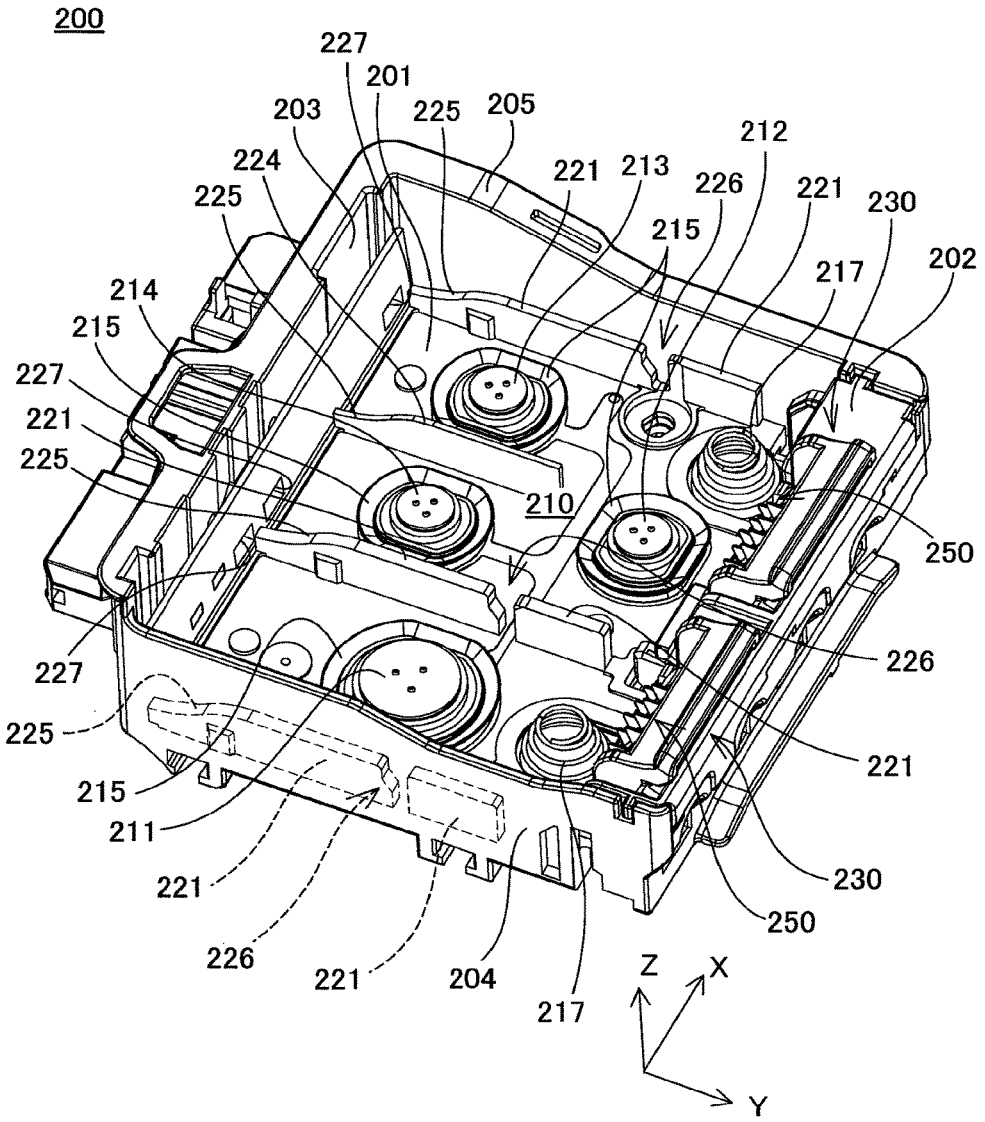
FIG. 14 is a perspective top view illustrating the holder structure from a front side.
Figure 15:
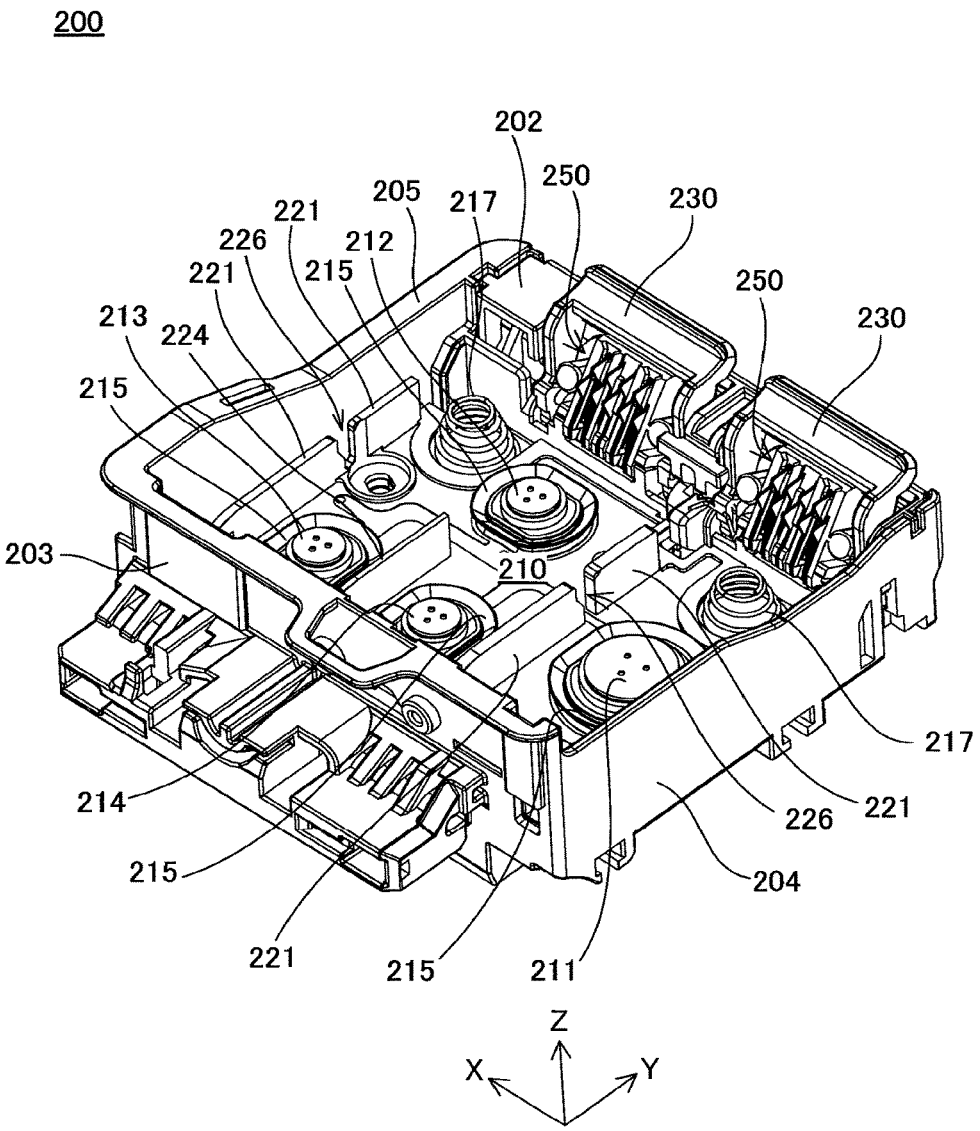
FIG. 15 is a perspective top view illustrating the holder structure from a rear side.
Figure 16:
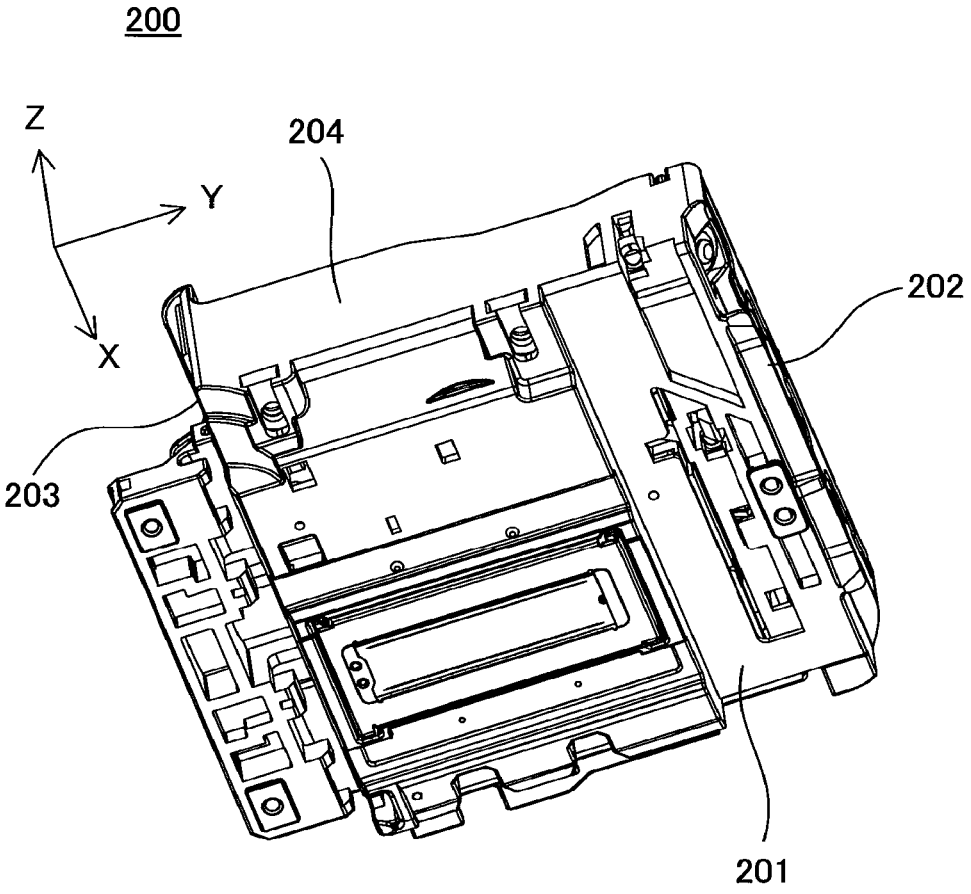
FIG. 16 is a perspective bottom view illustrating the holder structure.

The general configuration of the holder structure 200 is described with reference to FIGS. 14 to 16. FIG. 14 is a perspective top view illustrating the holder structure 200 from the front side. FIG. 15 is a perspective top view illustrating the holder structure 200 from the rear side. FIG. 16 is a perspective bottom view illustrating the holder structure 200. The holder structure 200 is formed as the approximately rectangular parallelepiped box-like member having the upper opening as described above. The holder structure 200 has five walls 201 to 205 arranged to surround a cartridge chamber 210 which receives the first and the second ink cartridges 100*a* and 100*b* placed therein.

The bottom wall 201 forms a bottom surface of the cartridge chamber 210. The front wall 202 and the rear wall 203 are respectively extended substantially vertically upward from a front-side end and a rear-side end of the bottom wall 201 to form a front surface and a rear surface of the cartridge chamber 210. The first side wall 204 and the second side wall 205 are respectively extended substantially vertically upward from a left-side end and a right-side end of the bottom wall 201 to form a left side surface and a right side surface of the cartridge chamber 210.

The bottom wall 201 has ink receiving parts 211 to 214 as shown in FIGS. 14 and 15 to be connected respectively with the ink supply port 100 of the first ink cartridge 100 and with the ink supply ports 100*a* to 100*c* of the second ink cartridge 100*b*. A seal member 215 is provided on the outer periphery of each of the ink receiving parts 211 to 214 to suppress invasion of the air to the ink flow path, as well as leakage of ink to outside.

The bottom wall 201 has pressing mechanisms 217 configured to respectively press upward the first and the second ink cartridges 100*a* and 100*b*. According to this embodiment, the pressing mechanisms 217 are made by helical springs. Each of the pressing mechanisms 217 is located at a position adjacent to a lever member 230. This configuration enhances the engagement force between the main engagement parts 120 and the lever members 230 which are to be engaged with each other in the state of attachment of the first and the second ink cartridges 100*a* and 100*b* and enhances the attachment of the first and the second ink cartridges 100*a* and 100*b* to the holder structure 200. In the course of detachment of the first or the second ink cartridge 100*a* or 100*b* from the holder structure 200, the pressing mechanism 217 presses upward the first or the second ink cartridge 100*a* or 100*b*, so as to enhance the operability of detachment.

The bottom wall 201 also has first sub-wall members 221 and a second sub-wall member 224 which are arranged parallel to the first side wall 204 and the second side wall 205 and have lower heights. The first sub-wall members 221 are provided at the positions adjacent to the first side wall 204 and adjacent to the second side wall 205 and at the position corresponding to the boundary position between the first and the second ink cartridges 100*a* and 100*b*. The second sub-wall member 224 is provided at the position corresponding to the boundary position between the second and the third ink chambers 108*b* and 108*c* in the area where the second ink cartridge 100*b* is attached.

The first sub-wall member 221 has a sloped section 225 formed on its rear end to have the height gradually decreasing backward. The first sub-wall member 221 also has a cut 226 in the middle of the cartridge chamber 210 in the direction of the arrow Y. The sloped sections 225 and the cuts 226 work as guides to guide the motions of the first and the second ink cartridges 100*a* and 100*b* in the course of attachment of the first and the second ink cartridges 100*a* and 100*b* to the holder structure 200. Detailed description of this function of the sloped sections 225 and the cuts 226 is described later.

The second sub-wall member 224 has a sloped section 225 formed on its rear end, like the first sub-wall member 221. The sloped section 225 of the second sub-wall member 224 also works as a guide to guide the motion of the second ink cartridge 100*b* in the course of attachment of the second ink cartridge 100*b* to the holder structure 200. The second sub-wall member 224 is fit in the groove 118 as shown in FIG. 11 formed in the first wall 101 of the second ink cartridge 100*b* and accordingly serves to fix the second ink cartridge 100*b*.

The lever members 230 are provided on the front wall 202 as shown in FIG. 15. Providing the lever members 230 on the front wall 202 facilitates the user's access to the lever members 230 for attachment and detachment of the first and the second ink cartridges 100*a* and 100*b*. Device-side terminal assemblies 250 are located below the respective lever members 230 to come into contact with the terminal assemblies 131 of the circuit substrates 130 of the first and the second ink cartridges 100*a* and 100*b*. The detailed structures of the lever member 230 and the device-side terminal assembly 250 will be described below.

A plurality of fitting holes 227 are provided at a lower edge of the cartridge chamber 210-side wall surface of the rear wall 203 as shown in FIG. 14 to be arrayed in the direction of the arrow X. In the course of attachment of the first or the second ink cartridge 100*a* or 100*b*, the plurality of projections 114 as shown in FIGS. 5 and 11 provided at the lower edge of the third wall 103 of each of the ink cartridges 100*a* and 100*b* are inserted and fit in the fitting holes 227.

Figure 17:
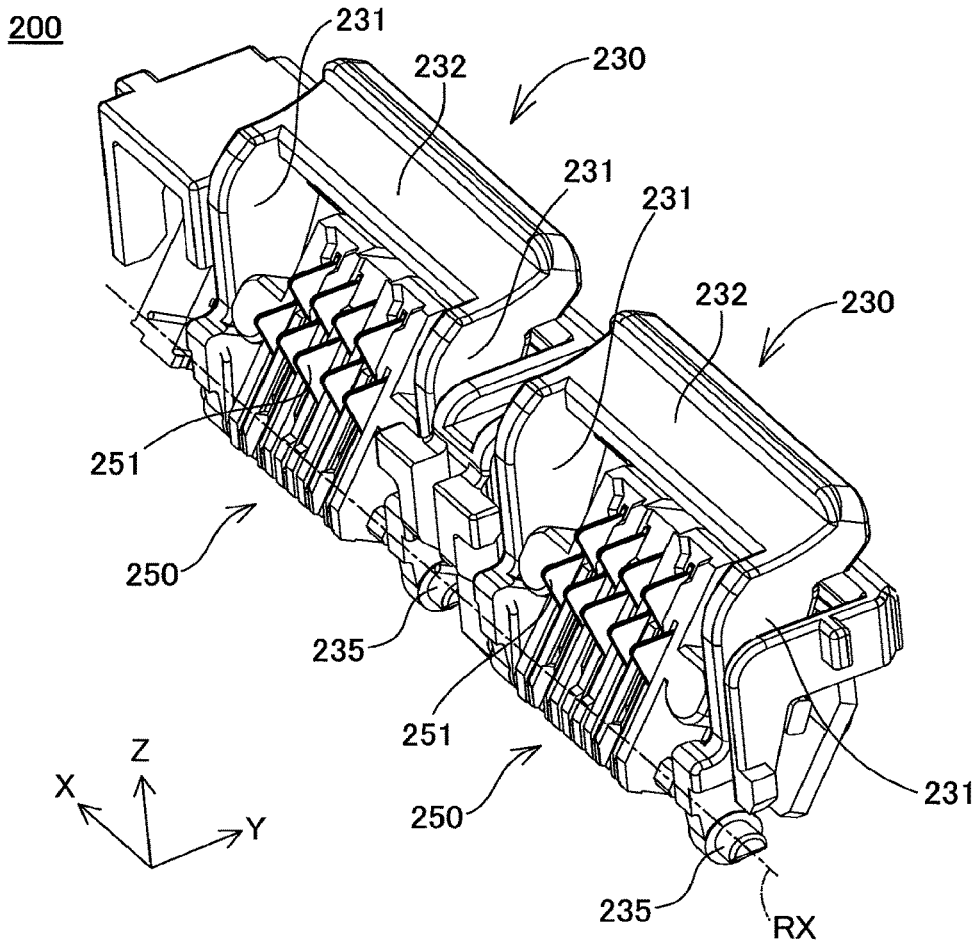
FIG. 17 is a perspective top view illustrating lever members and device-side terminal assemblies in a state attached to the holder structure.
Figure 18:
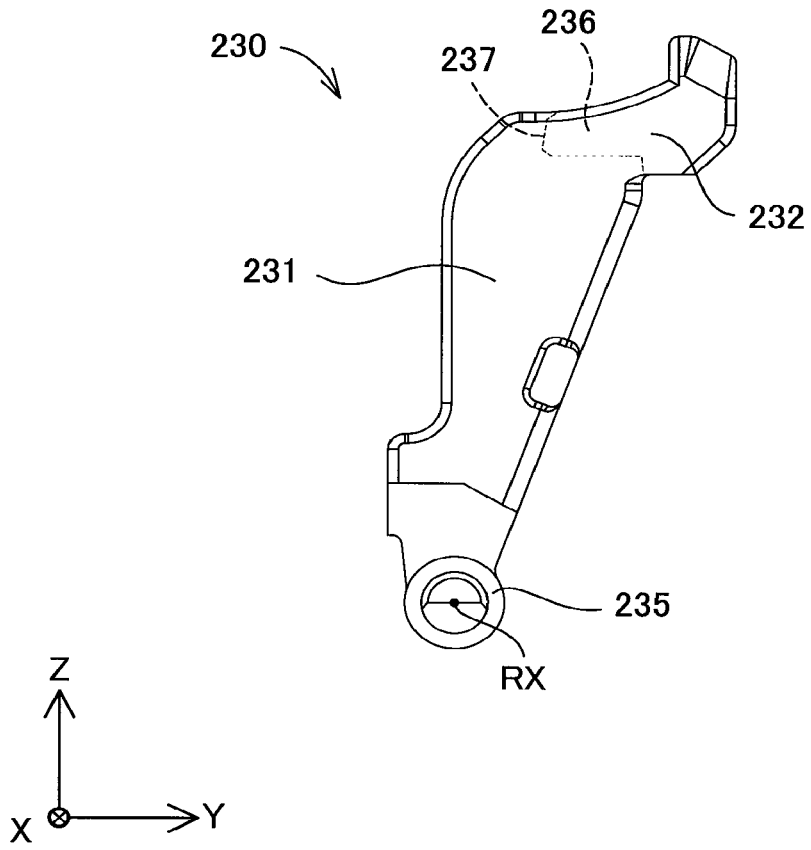
FIG. 18 is a side view illustrating the lever member.

The structures of the lever member 230 and the device-side terminal assembly 250 of the holder structure 200 are described with reference to FIGS. 17 and 18. FIG. 17 is a perspective top view illustrating the periphery of the lever members 230 and the device-side terminal assemblies 250 in the state attached to the front wall 202 of the holder structure 200. FIG. 18 is a side view illustrating the lever member 230. A rotation axis RX of the lever member 230 is illustrated in FIGS. 17 and 18.

The lever member 230 serves as an engaged part to be engaged with the main engagement part 120 of each of the first and the second ink cartridges 100*a* and 100*b*. The lever member 230 has two leg sections 231 extended in the direction of the arrow Z and a bridging section 232 arranged to bridge upper edges of the two leg sections 231. Each of the leg sections 231 has a convex 235 provided at its lower edge to be protruded outward in the direction of the arrow X.

The respective convexes 235 are fit in recesses (not shown) formed in the front wall 202, so that the lever member 230 is attached to be rotatable in the front-back direction about center axes of the respective convexes 235 as the rotation axis RX. In the holder structure 200, the lever member 230 is pressed backward by a pressing mechanism (not shown) and is stopped to rest at a specified angle of rotation.

The bridging section 232 of the lever member 230 has a flat plate part 236 as shown in FIG. 18 linked with the leg sections 231 and extended forward. The flat plate part 236 corresponds to the engaged part. In the state that each of the first and the second ink cartridges 100*a* and 100*b* is attached to the holder structure 200, the lower surface of the flat plate part 236 is in surface contact with the upper surfaces of the respective brim sections 121 and 123 of the main engagement part 120 as shown in FIGS. 5 and 11 of each of the ink cartridges 100*a* and 100*b*. As described later, a rear end face 237 of the flat plate part 236 comes into contact with the first side wall portion 125 and the second side wall portion 126 of the main engagement part 120 in the state of attachment of each of the first and the second ink cartridges 100*a* and 100*b*.

The device-side terminal assembly 250 as shown in FIG. 17 is formed in a plate-like shape and has a plurality of terminals 251 arrayed on a rear surface corresponding to the respective terminals 151 to 159 of the terminal assembly 131 as shown in FIG. 9 of each of the first and the second ink cartridges 100*a* and 100*b*. The respective terminals 251 are protruded in the thickness direction of the device-side terminal assembly 250. The respective terminals 251 are pressed in the protruding direction by a pressing mechanism not shown in Figures placed inside of the device-side terminal assembly 250. The device-side terminal assembly 250 is fixed to the front wall 202 of the holder structure 200 independently of the lever member 230 to have an angle of inclination corresponding to the angle of inclination of the circuit substrate 130 of each of the first and the second ink cartridges 100*a* and 100*b*.

[Mounting Mechanism of Ink Cartridge to Holder Structure]

Figure 19:
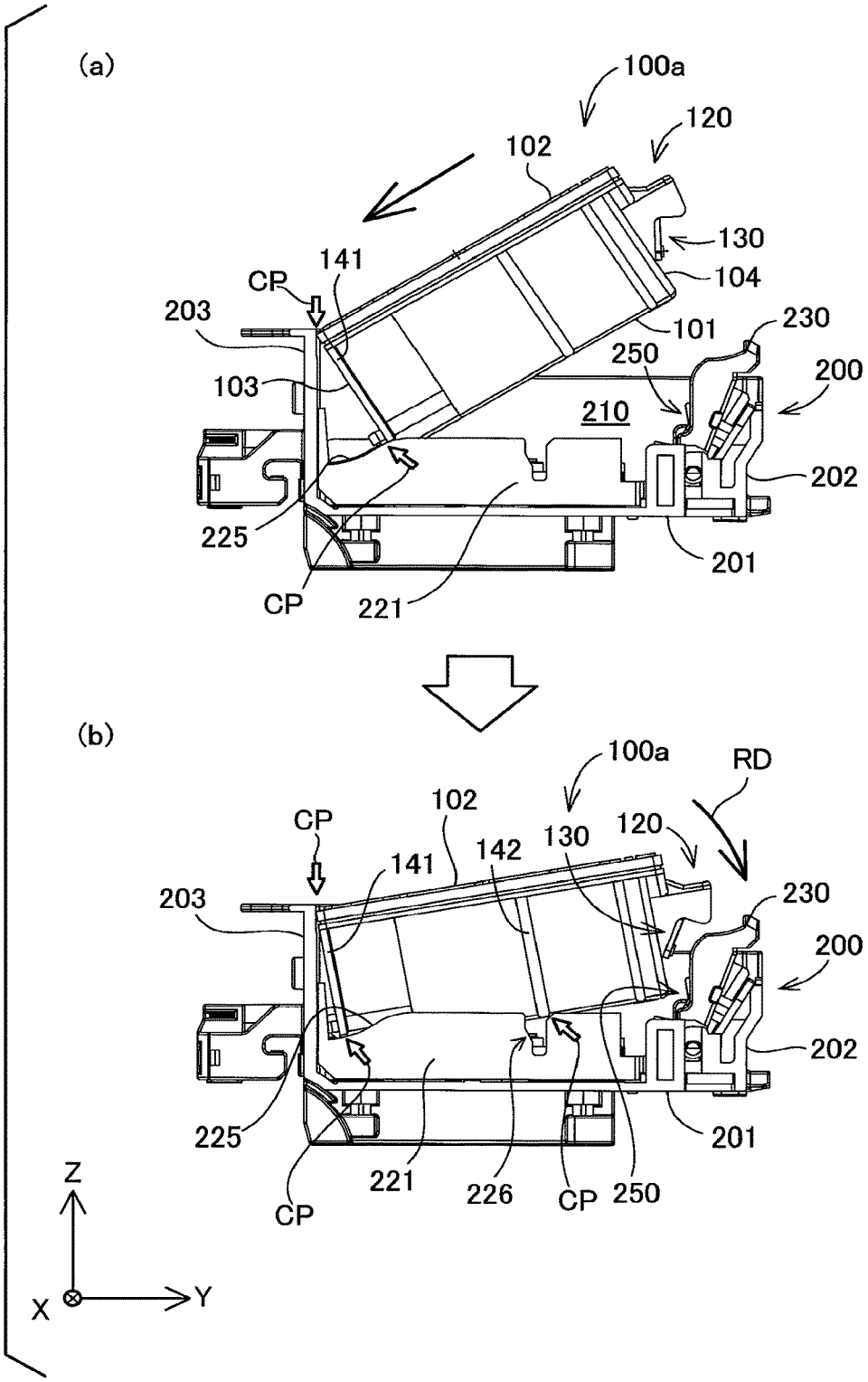
FIG. 19 is schematic diagrams illustrating an attachment process of the first ink cartridge to the holder structure in times series.
Figure 20:
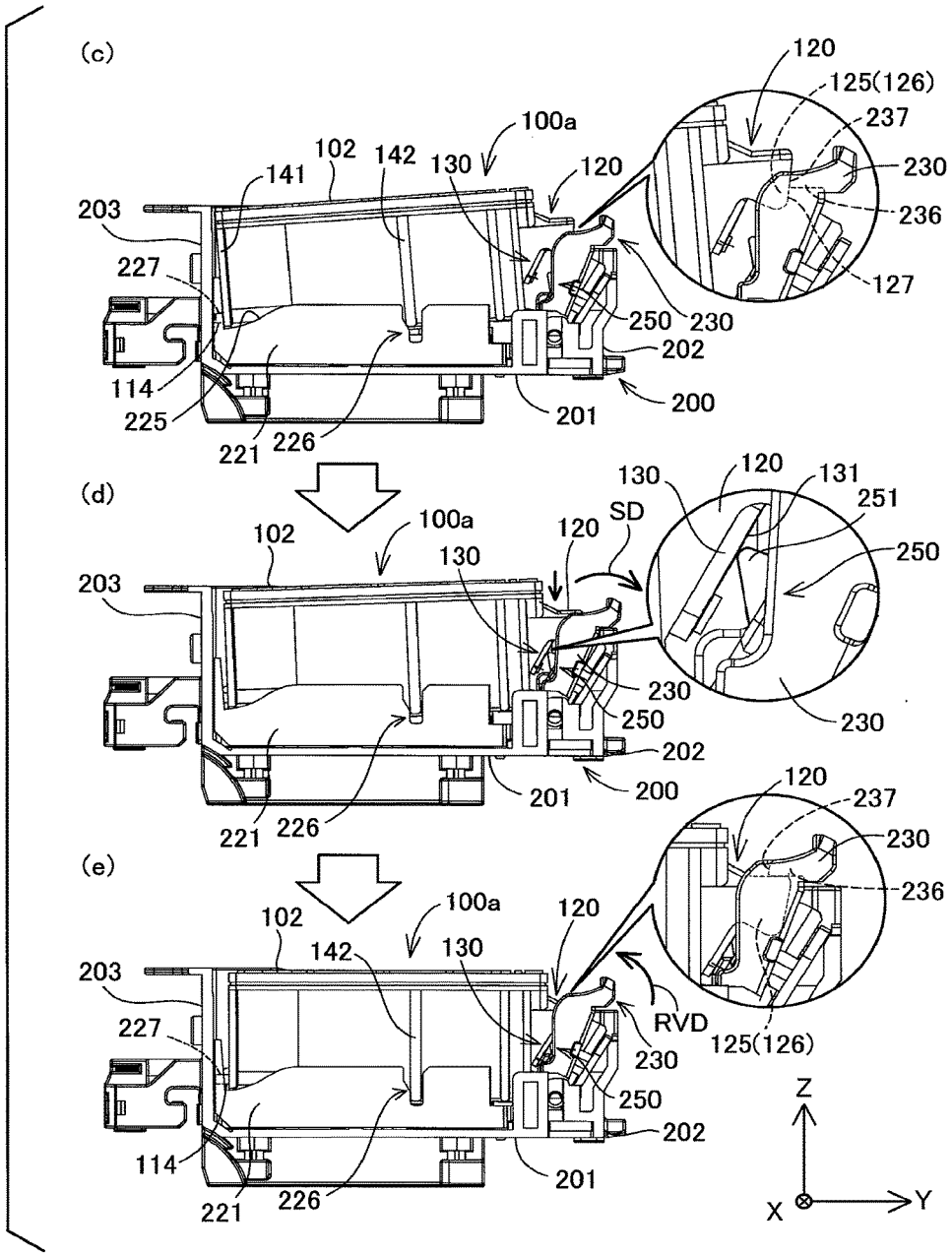
FIG. 20 is schematic diagrams illustrating the attachment process of the first ink cartridge to the holder structure in time series.

FIGS. 19 and 20 are schematic diagrams illustrating an attachment process of the first ink cartridge 100*a* to the holder structure 200 in time series. Sections (a), (b) of FIG. 19 and sections (c), (d), (e) of FIG. 20 sequentially show the process of attachment of the first ink cartridge 100*a* to the holder structure 200. As a matter of convenience, the first side wall 204 of the holder structure 200 is omitted from the illustrations of FIGS. 19 and 20. Arrows CP in FIG. 19 indicate the positions where the first ink cartridge 100*a* is in contact with the holder structure 200. The attachment process of the second ink cartridge 100*b* to the holder structure 200 is substantially the same as the attachment process of the first ink cartridge 100*a* and is thus neither specifically illustrated nor described herein.

In a first step as shown in section (a) of FIG. 19, the first ink cartridge 100*a* is inclined with the third wall 103-side facing down and is brought closer to the holder structure 200. The upper edge of the third wall 103 of the first ink cartridge 100*a* then comes into contact with the upper edge of the rear wall 203 of the holder structure 200, whereas the lower edges of the first ribs 141 at the rear ends of the fifth wall 105 and the sixth wall 106 come into contact with the upper edges of the first sub-wall members 221.

In a second step as shown in section (b) of FIG. 19, the first ink cartridge 100*a* is rotated and moved downward as shown by an arrow RD about the contact between the upper edge of the rear wall 203 of the holder structure 200 and the upper edge of the third wall 103 of the first ink cartridge 100*a* as the supporting point. In this state, the lower edges of the first ribs 141 slide and start moving along the upper surfaces of the sloped sections 225 of the first sub-wall members 221, while the lower edges of the second ribs 142 come into contact with the upper edges of the cuts 226 of the first sub-wall members 221. In the description herein, the term "sliding" means relatively moving in a friction-causing direction in the state of contact with another object.

In a third step as shown in section (c) of FIG. 20, the main engagement part 120 of the first ink cartridge 100*a* comes into contact with the lever member 230 of the holder structure 200. More specifically, front end faces 127 of the first side wall portion 125 and the second side wall portion 126 of the main engagement part 120 are in surface contact with the end face 237 of the flat plate part 236 in the bridging section 232 of the lever member 230. The plurality of projections 114 provided at the lower edge of the third wall 103 of the first ink cartridge 100*a* are inserted into the corresponding fitting holes 227 of the holder structure 200. The first ink cartridge 100*a* is then rotated and moved about the contacts between the projections 114 and the fitting holes 227 as the supporting points.

In a fourth step as shown in section (d) of FIG. 20, the rotating and moving the first ink cartridge 100*a* continues, so that the main engagement part 120 moves downward. The lever member 230 is pressed by the first side wall portion 125 and the second side wall portion 126 of the main engagement part 120 to be moved forward, i.e., in the direction away from the main engagement part 120 as shown by an arrow SD. In the description herein, "moving in the direction away from" is not limited to moving to be actually away from an object but also includes moving in a direction opposite to an object with keeping the distance from the object unchanged. The end faces 127 of the first side wall portion 125 and the second side wall portion 126 of the main engagement part 120 respectively correspond to the first pressure surface and the second pressure surface. In the first ink cartridge 100*a* of this embodiment, the lever member 230 is rotated and moved by the main engagement part 120. This configuration does not require the rotating and moving action of the lever member 230 by the user's finger.

In the fourth step, each of the contact portions CP of the respective terminals 151 to 159 of the terminal assembly 131 on the circuit substrate 130 of the first ink cartridge 100*a* as shown in FIG. 9 comes into contact with corresponding one of the plurality of terminals 251 of the device-side terminal assembly 250 of the holder structure 200. Accompanied with the downward move of the first ink cartridge 100*a*, the contact portions CP of the respective terminals 151 to 159 of the first ink cartridge 100*a* are slid against the surfaces of contact portions CP of the corresponding terminals 251 of the holder structure 200. The term "sliding" herein means moving relative to an object to cause friction. Such sliding removes extraneous matters such as stains or blots on the surfaces of the contact portions CP of the terminals, thus ensuring the better electric contact between the terminals.

In a fifth step as shown in section (e) of FIG. 20, the rotating and moving the first ink cartridge 100*a* is completed, and the first wall 101 is supported by the bottom wall 201 of the holder structure 200. The lower edges of the second ribs 142 reach the lower edges of the cuts 226 of the first sub-wall members 221, so that the positions of the second ribs 142 are fixed. In this state, the plurality of projections 114 provided at the lower edge of the third wall 103 of the first ink cartridge 100*a* are inserted and fit in the corresponding fitting holes 227 of the holder structure 200. This serves as the engagement mechanism to lock the first ink cartridge 100*a* to the holder structure 200.

Additionally, in the fifth step, moving the main engagement part 120 to the lowermost position releases the touch between the first side wall portion 125 and the second side wall portion 126 of the main engagement part 120 and the bridging section 232 of the lever member 230. Accordingly, the lever member 230 is returned to its rear-side initial position (as shown by an arrow RVD) by the pressing mechanism at its lower end, and its bridging section 232 moves above the respective brim sections 121 and 123 of the main engagement part 120. The upper surfaces of the respective brim sections 121 and 123 are then in surface contact with the lower surface of the flat plate part 236 of the lever member 230, so that the main engagement part 120 is engaged with the lever member 230. This series of steps causes the first ink cartridge 100*a* to be attached to the holder structure 200.

Figure 21:
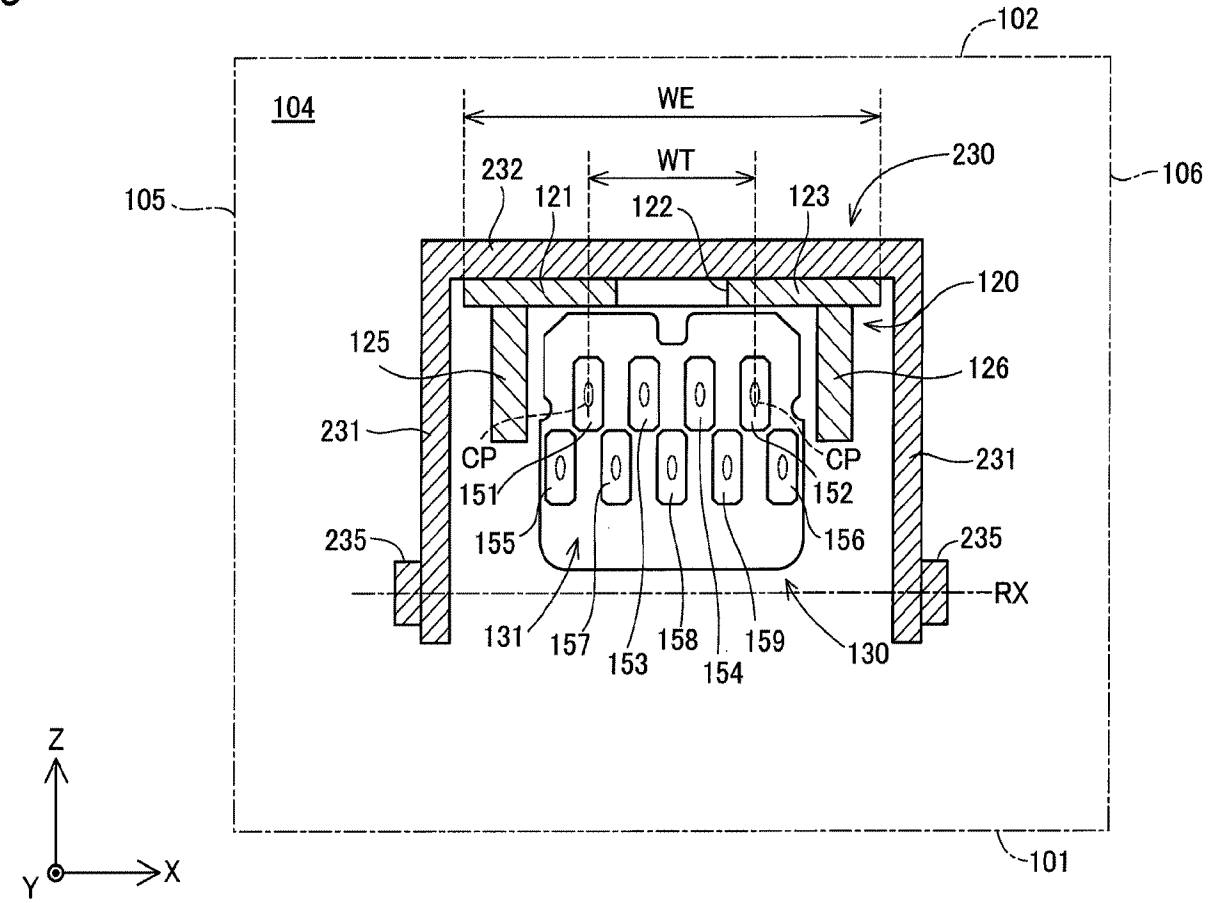
FIG. 21 is a diagram illustrating the relationship between the state of engagement of a main engagement part with the lever member and the connectivity of the circuit substrate.

FIG. 21 is a diagram illustrating the relationship between the state of engagement of the main engagement part 120 with the lever member 230 and the connectivity of the circuit substrate 130. FIG. 21 schematically illustrates the state of engagement of the main engagement part 120 with the lever member 230 and the array configuration of the circuit substrate 130 in this state. FIG. 21 also shows the schematic outer contour of the fourth wall 104 of the first ink cartridge 100*a* by the dashed line. The description regarding the first ink cartridge 100*a* with reference to FIG. 21 is also applicable to the second ink cartridge 100*b*.

In the main engagement part 120 of this embodiment, a distance WE between the respective outer edges of the two brim sections 121 and 123 in the direction of the arrow X, at which the main engagement part 120 is engaged with the lever member 230, is wider than an interval WT between the contact portions CP of the first and the second terminals 151 and 152 on both ends of the circuit substrate 130 in the direction of the arrow X. The interval WT in the direction of the arrow X between the contact portions CP of the first and the second terminals 151 and 152 means the distance between the centerlines of the respective contact portions CP. In the main engagement part 120 of the embodiment, this configuration ensures the sufficient width of the area to be engaged with the engaged part and enhances the engagement with the holder structure 200. This accordingly enhances the connectivity of the respective terminals 151 to 156 of the circuit substrate 130.

Especially, the circuit substrate 130 is located below the respective brim sections 121 and 123 of the main engagement part 120, so that the circuit substrate 130 is pressed against the device-side terminal assembly 250 by the engagement of the main engagement part 120 with the lever member 230. This accordingly ensures the high connectivity with the device-side terminal assembly 250.

Additionally, in the configuration of this embodiment, the distance from the fifth wall 105 to the outer edge of the first brim section 121 is shorter than the distance from the fifth wall 105 to the contact portion CP of the first terminal 151. The distance from the sixth wall 106 to the outer edge of the second brim section 123 is shorter than the distance from the sixth wall 106 to the contact portion CP of the second terminal 152. Accordingly, the circuit substrate 130 is pressed in its entire width direction as shown by the arrow X against the device-side terminal assembly 250 by the engagement of the main engagement part 120 with the lever member 230. This suppresses the circuit substrate 130 from obliquely coming into contact with the device-side terminal assembly 250 in the direction of the arrow X, thus ensuring the higher connectivity.

In the configuration of this embodiment, the cut 122 is provided between the respective brim sections 121 and 123 of the main engagement part 120, and the center area of the main engagement part 120 in the direction of the arrow X does not come into contact with the bridging section 232 of the lever member 230. This suppresses the area of the main engagement part 120 other than the respective ends from coming into contact with the bridging section 232 of the lever member 230 and thereby suppresses inclination of the main engagement part 120 in the direction of the arrow X. Accordingly, this further suppresses the circuit substrate 130 from obliquely coming into contact with the device-side terminal assembly 250.

According to this embodiment, in the state that the first and the second ink cartridges 100*a* and 100*b* are attached to the holder structure 200, the center of the main engagement part 120 in the direction of the arrow X is located at substantially the same position as the center of the lever member 230 in the direction of the arrow X. In the front view of the fourth wall 104, the direction of the array of the areas of the respective brim sections 121 and 123 of the main engagement part 120 to be engaged with the lever member 230 is identical with the direction of array of the contact portions CP of the first and the second terminals 151 and 152 of the circuit substrate 130. This configuration suppresses a bias of the force applied to the contact portions CP of the first and the second terminals 151 and 152 by the engagement of the main engagement part 120 with the lever member 230.

Figure 22:
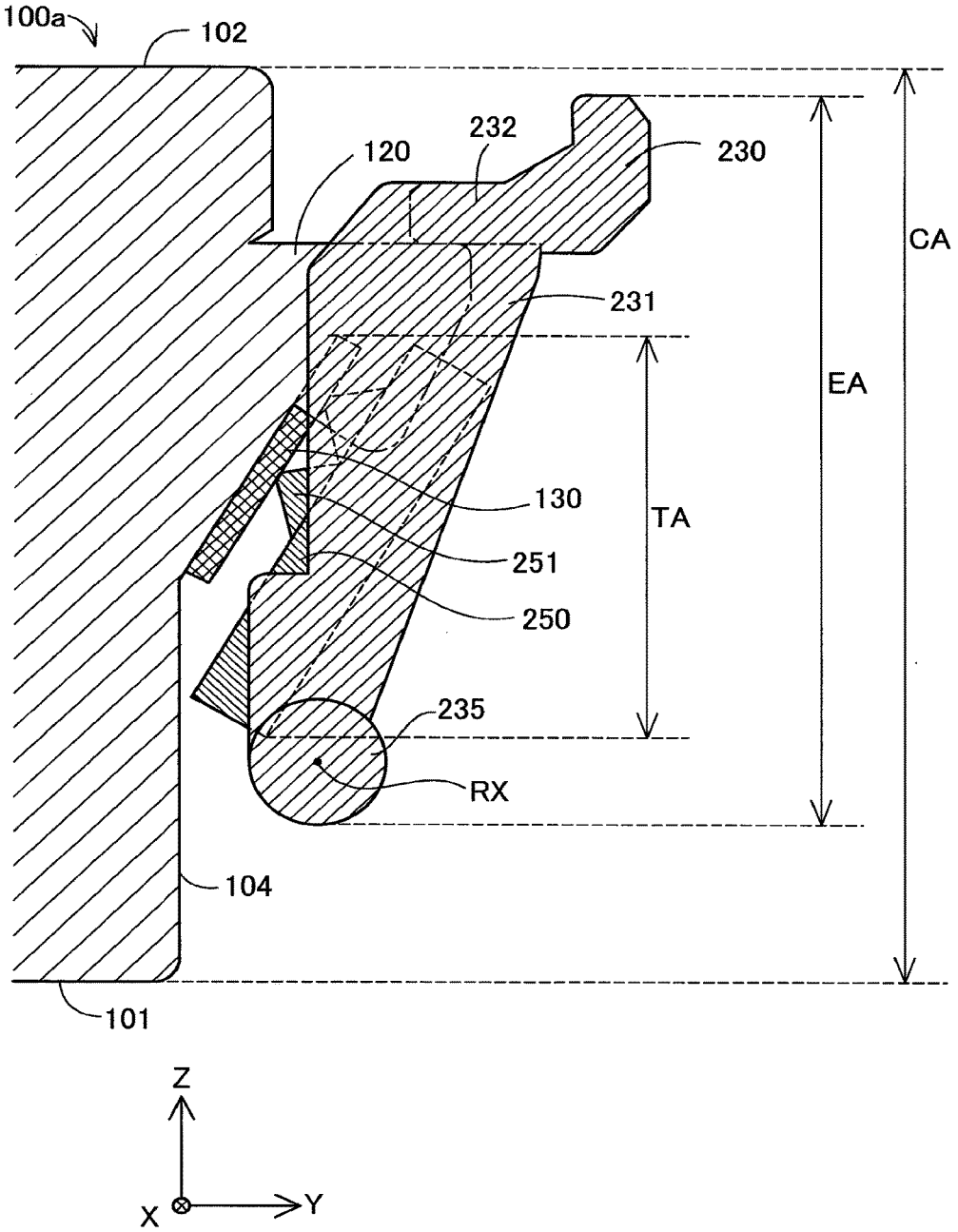
FIG. 22 is a diagram illustrating the engagement mechanism of the lever member with the main engagement part.

FIG. 22 is a diagram illustrating the engagement mechanism of the lever member 230 with the main engagement part 120. FIG. 22 schematically illustrates the state that the main engagement part 120 of the first ink cartridge 100*a* is engaged with the lever member 230 of the holder structure 200 in its side view. The following description regarding the first ink cartridge 100*a* with reference to FIG. 22 is also applicable to the second ink cartridge 100*b*.

In the printing device 10 of this embodiment, the convexes 235 as the center of the rotating motion of the lever member 230 is provided at the position near to the lower end of the first ink cartridge 100*a* and is located below the main engagement part 120 and the circuit substrate 130 of the first ink cartridge 100*a*. In the printing device 10 of this embodiment, the radius of the rotating motion of the lever member 230 is maximized in a range CA from the upper end to the lower end of the first ink cartridge 100*a*.

This reduces the external force required to rotating and moving the lever member 230 (principle of leverage). Accordingly, this reduces the external force required by the first side wall portion 125 and the second side wall portion 126 of the main engagement part 120 to press the lever member 230 in the course of attachment of the first ink cartridge 100*a*. This also reduces the force to be applied by the user to the bridging section 232 of the lever member 230 in the course of detachment of the first ink cartridge 100*a*. This accordingly improves the operability during attachment and detachment of the first ink cartridge 100*a*.

Additionally, the force applied to the lever member 230 at the position near to the rotation axis RX by the pressing mechanism is increased in its engagement area. This accordingly allows for downsizing of the pressing mechanism and improves the engagement of the main engagement part 120 with the lever member 230. The bridging section 232 of the lever member 230 is located near to the upper end of the first ink cartridge 100*a*. This enables the user to readily access the bridging section 232 of the lever member 230 in the course of detachment of the first ink cartridge 100*a*, thus ensuring the high operability.

In the printing device 10 of the embodiment, an area EA occupied by the engagement mechanism between the main engagement part 120 and the lever member 230 is substantially overlapped in the height direction as shown by the arrow Z with an area TA occupied by the electric connection mechanism between the circuit substrate 130 and the device-side terminal assembly 250. More specifically, the area TA occupied by the electric connection mechanism is included in the area EA occupied by the engagement mechanism. In the printing device 10 of the embodiment, the engagement mechanism and the electric connection mechanism between the first ink cartridge 100*a* and the holder structure 200 are arranged intensively. This ensures the high space use efficiency in the printing device 10.

In order to achieve the advantageous effect of the lever member 230 based on the principle of leverage described above and ensure the radius of rotation of the lever member 230, it is not easy to reduce the range of the area EA in the height direction occupied by the engagement mechanism. A configuration that the above two areas EA and TA are separately arranged in the height direction increases the total range occupied by the engagement mechanism and the electric connection mechanism and is likely to decrease the space use efficiency. The "configuration that the two areas EA and TA are separately arranged in the height direction" includes the configuration that the two areas EA and TA are separately arranged in the height direction with some overlap. In the printing device 10 of this embodiment, this arrangement improves the attachment of the first ink cartridge 100*a* and the operability during attachment and detachment of the first ink cartridge 100*a* and enhances the space use efficiency in the printing device 10.

Figure 23:
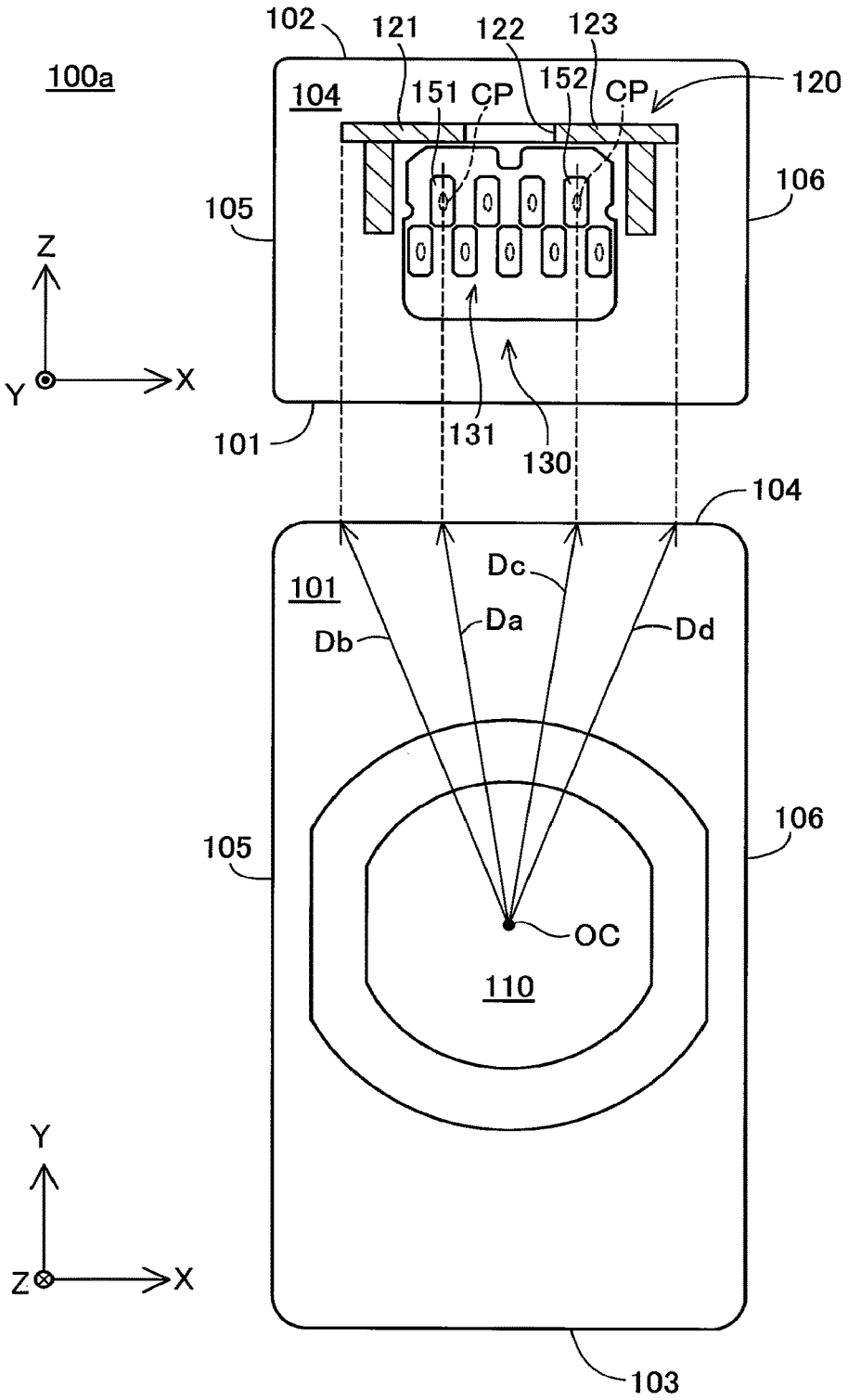
FIG. 23 is a diagram illustrating the relationship between the state of engagement of the main engagement part with the lever member and the connectivity of ab ink supply port.

FIG. 23 is a diagram illustrating the relationship between the state of engagement of the main engagement part 120 with the lever member 230 and the connectivity of the ink supply port 110. The upper drawing of FIG. 23 illustrates the main engagement part 120 and the circuit substrate 130 in the plan view of the fourth wall 104 in the direction opposite to the direction of the arrow Y. The lower drawing of FIG. 23 illustrates the plan view of the first wall 101 in the direction of the arrow Z in such a manner as to correspond to the upper drawing. The following description regarding the ink supply port 110 of the first ink cartridge 100*a* with reference to FIG. 23 is also applicable to the first ink supply port 110*a* of the second ink cartridge 100*b*.

In the first ink cartridge 100*a*, a distance Da from a center OC of the ink supply port 110 to the contact portion CP of the first terminal 151 is shorter than a distance Db from the center OC of the ink supply port 110 to the fifth wall 105-side end of the main engagement part 120 in the plan view in the direction of the arrow Z. Similarly, a distance Dc from the center OC of the ink supply port 110 to the contact portion CP of the second terminal 152 is shorter than a distance Dd from the center OC of the ink supply port 110 to the sixth wall 106-side end of the main engagement part 120.

As described above, in the first ink cartridge 100*a* of the embodiment, there is a sufficient distance from the center OC of the ink supply port 110 to the area of the main engagement part 120 which is engaged with the lever member 230 of the holder structure 200. Accordingly, the force applied to the first ink cartridge 100*a* by the engagement of the main engagement part 120 with the lever member 230 is sufficiently increased at the ink supply port 110 by the principle of leverage. This enhances the connectivity of the ink supply port 110.

As described above, the first ink cartridge 100*a* of this embodiment is attached to the holder structure 200 by the rotating motion about the point of contact between the upper edge of the third wall 103 and the rear wall 203 of the holder structure 200 as the supporting point as shown in FIGS. 19 and 20. In this state of attachment, the external force applied to the first ink cartridge 100*a* when the fourth wall 104 is moved downward is increased as the force in the direction of pressing the ink supply port 110 against the ink receiving part 211 by the principle of leverage. This further enhances the connectivity of the ink supply port 110.

Additionally, in the first ink cartridge 100*a* of the embodiment, the center OC of the ink supply port 110 is located between the contact portion CP of the first terminal 151 and the contact portion CP of the second terminal 152 and also between the brim sections 121 and 123 of the main engagement part 120 in the direction of the arrow X. Accordingly, in the state that the engagement of the main engagement part 120 with the lever member 230 ensures the connection of both the first terminal 151 and the second terminal 152, the engagement also ensures the connection of the ink supply port 110 with the ink receiving part 211. In the course of attachment of the first ink cartridge 100*a*, this reduces a positional change of the ink supply port 110 caused by inclination of the first ink cartridge 100*a* to the direction of the arrow X and enhances the connectivity of the ink supply port 110 with the ink receiving part 211.

As described above, the presence of the main engagement part 120 enhances the attachment of the first and the second ink cartridges 100*a* and 100*b* of the embodiment to the holder structure 200 of the printing device 10. This also improves the operability of attachment and detachment of the first and the second ink cartridges 100*a* and 100*b* to and from the holder structure 200. Additionally, this enhances the space efficiency of the mechanisms for attachment of the first and the second ink cartridges 100*a* and 100*b* in the printing device 10.

B. Second Embodiment

Figure 24:
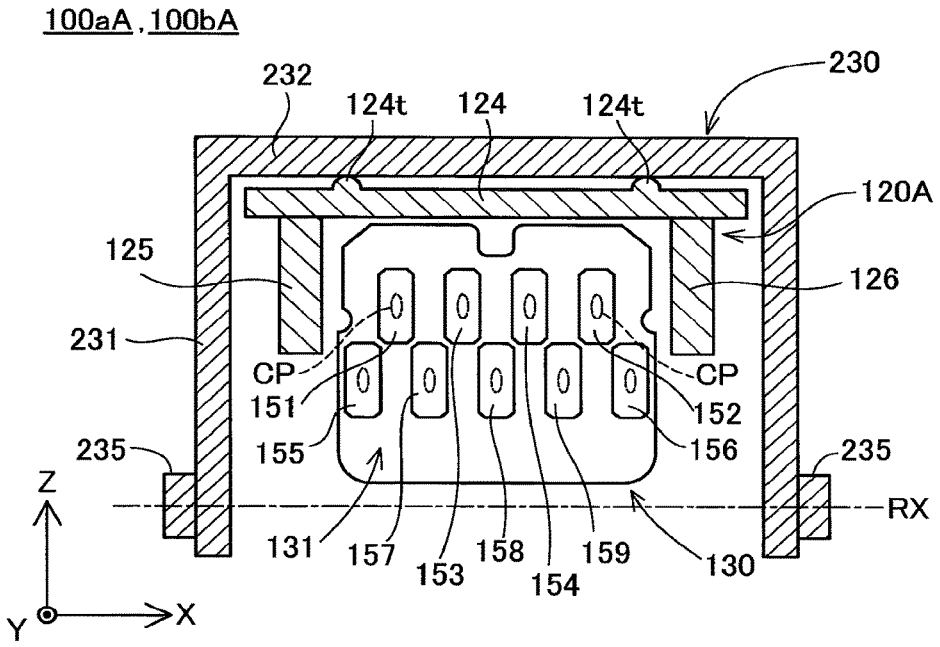
FIG. 24 is a schematic diagram illustrating the configuration of first and second ink cartridges according to a second embodiment.

FIG. 24 is a schematic diagram illustrating the configuration of first and second ink cartridges 100*a*A and 100*b*A according to a second embodiment of the invention. FIG. 24 schematically illustrates the front view of a main engagement part 120A included in each of the first and the second ink cartridges 100*a*A and 100*b*A. The first and the second ink cartridges 100*a*A and 100*b*A of the second embodiment have configurations substantially similar to those of the first and the second ink cartridges 100*a* and 100*b* of the first embodiment, except that the main engagement part 120A has different structure. The first and the second ink cartridges 100*a* and 100*b* of the second embodiment are attachable to and detachable from the carriage 27 of the printing device as shown in FIG. 2 via a holder structure 200 identical with that described in the first embodiment as shown in FIGS. 14 and 16.

The main engagement part 120A included in each of the first and the second ink cartridges 100*a*A and 100*b*A of the second embodiment has a single brim section 124 continuously extended in the direction of the arrow X. The brim section 124 has two convexes 124*t* protruded upward and located in respective end areas on the upper surface of the brim section 124. The main engagement part 120A comes into contact with the lower surface of the bridging section 232 of the lever member 230 by the two convexes 124*t*. The term "coming into contact" or "abutting" herein means that objects are in contact with each other to generate a pressure therebetween. The "contact" includes contact between flat surfaces and contact between a flat surface and a curved surface. The "contact" is not limited to direct contact between objects but includes even indirect contact between objects via some medium. The respective convexes 124*t* may be formed in a hemispherical shape or may be formed as ribs having an approximately semicircular cross section or an approximately rectangular cross section.

The interval between the two convexes 124*t* in the direction of the arrow X is wider than the interval between the first terminal 151 and the second terminal 152 of the circuit substrate 130. The contact portions CP of the first terminal 151 and the second terminal 152 of the circuit substrate 130 are located between the two convexes 124*t* in the direction of the arrow X. Like the main engagement part 120 of the first embodiment, the main engagement part 120A of the second embodiment also enhances the connectivity of the circuit substrate 130 with the device-side terminal assembly 250 of the holder structure 200. This also enhances the attachment of the first and the second ink cartridges 100*a* and 100*b* to the holder structure 200. The first and the second ink cartridges 100*a*A and 100*b*A of the second embodiment have the similar functions and advantageous effects to those of the first and the second ink cartridges 100*a* and 100*b* of the first embodiment.

C. Third Embodiment

Figure 25:
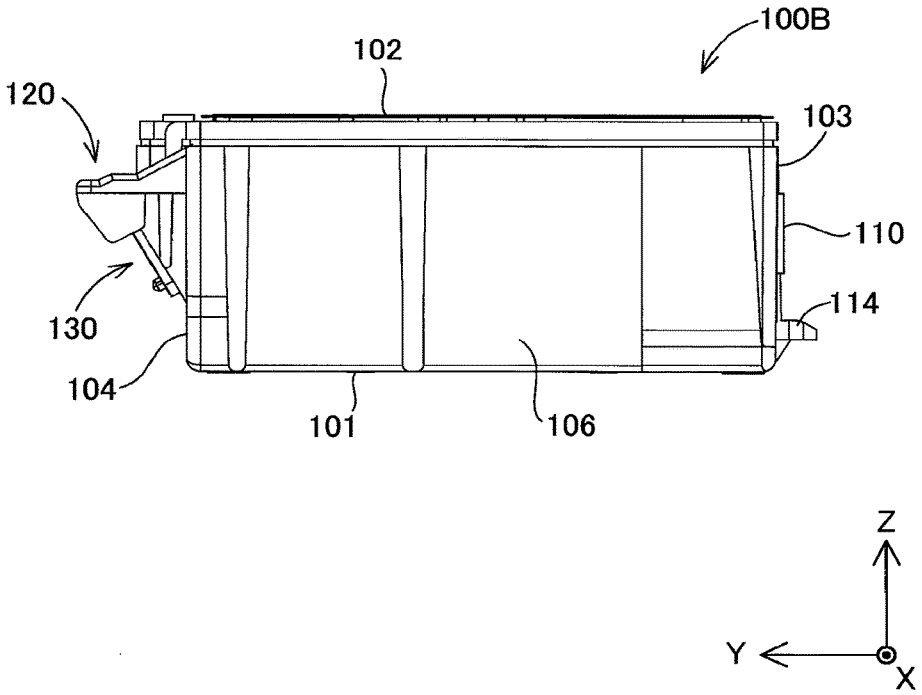
FIG. 25 is a schematic diagram illustrating the configuration of an ink cartridge according to a third embodiment.

FIG. 25 is a schematic diagram illustrating a side surface of an ink cartridge 100B according to a third embodiment of the invention. The ink cartridge 100B of the third embodiment has configuration substantially similar to that of the first ink cartridge 100*a* of the first embodiment, except that the ink supply port 110 is provided in the third wall 103 instead of the first wall 101. The ink cartridge 100B of the third embodiment is attached to the carriage 27 of the printing device 10 as shown in FIG. 2 via a holder structure 200 in which the location of formation of the ink receiving part 211 is changed to the rear wall 203 as shown in FIGS. 14 to 16. Like the first ink cartridge 100*a* of the first embodiment, the ink cartridge 100B of the third embodiment also has the main engagement part 120 and the circuit substrate 130 provided on the fourth wall 104. This configuration accordingly enhances the attachment to the printing device 10. The ink cartridge 100B of the third embodiment has the similar functions and advantageous effects to those of the first and the second ink cartridges 100*a* and 100*b* of the first embodiment.

D. Fourth Embodiment

Figure 26:
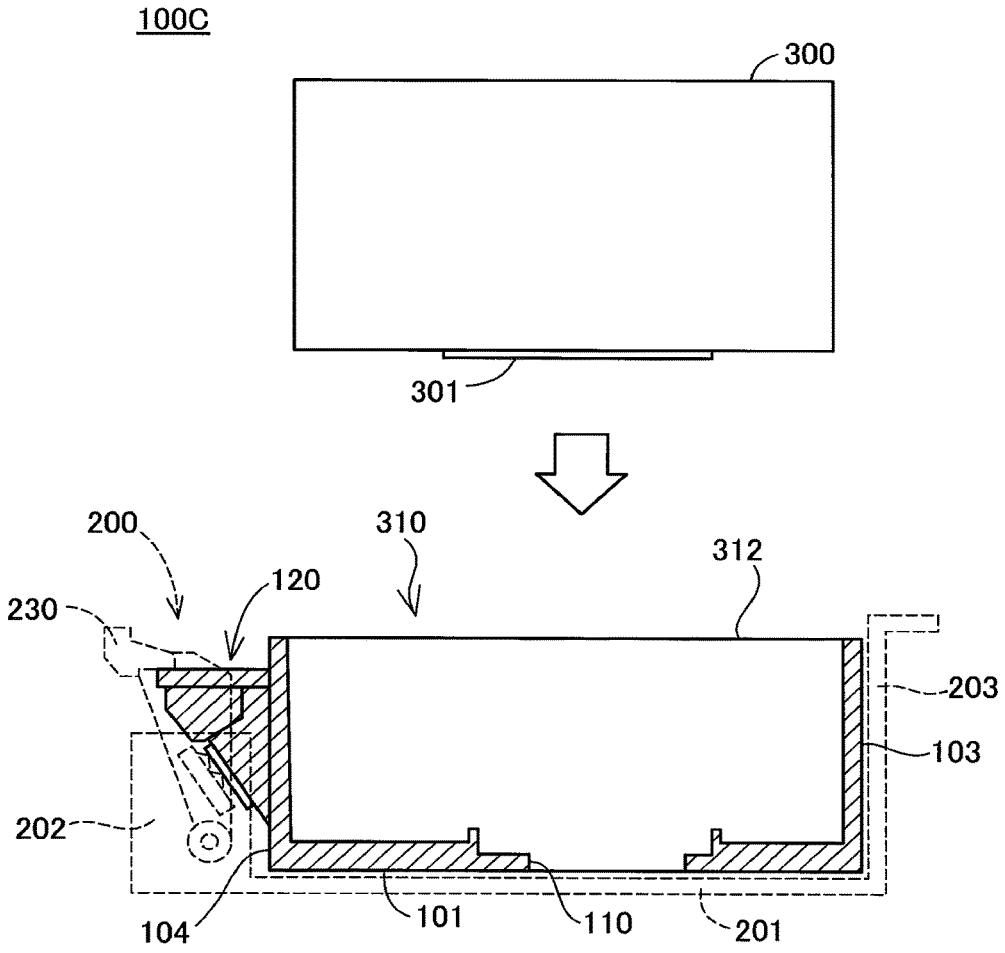
FIG. 26 is a schematic diagram illustrating the configuration of an ink cartridge according to a fourth embodiment.

FIG. 26 is a schematic diagram illustrating the configuration of an ink cartridge 100C according to a fourth embodiment of the invention. The like components in FIG. 26 to those described in the first embodiment are expressed by the like numerical symbols. The ink cartridge 100C of the fourth embodiment is attachable to and detachable from the carriage 27 of the printing device 10 as shown in FIG. 2 via the holder structure 200 described in the first embodiment as shown in FIGS. 14 to 16. The ink cartridge 100C of the fourth embodiment has an ink container 300 and an adaptor structure 310. The ink container 300 is provided as a liquid container internally having an ink chamber configured to contain ink. The ink container 300 has an ink outlet port 301 on its lower surface to be connected with an ink supply port 110 of the adaptor structure 310.

The adaptor structure 310 is provided as an exterior vessel configured to receive the ink container 300 through an upper opening 312. The adaptor structure 310 has walls similar to the first wall 101, the third wall 103, the fourth wall 104, the fifth wall 105 and the sixth wall 106 of the first ink cartridge 100*a* of the first embodiment. The first or bottom wall 101 of the adaptor structure 310 has an ink supply port 110 similar to that of the first ink cartridge 100*a* of the first embodiment. A main engagement part 120 and a circuit substrate 130 similar to those described in the first embodiment are disposed on the fourth or front wall 104.

The ink cartridge 100C of the fourth embodiment causes ink to be supplied to the printing device 10 by attaching the ink container 300 to the holder structure 200 via the adaptor structure 310. In the ink cartridge 100C of the fourth embodiment, the adaptor structure 310 has a main engagement part 120 corresponding to the lever member 230 of the holder structure 200. This configuration also enhances the attachment to the printing device 10. The ink cartridge 100C of the fourth embodiment has the similar functions and advantageous effects to those of the first and the second ink cartridges 100*a* and 100*b* of the first embodiment.

E. Fifth Embodiment

Figure 27:
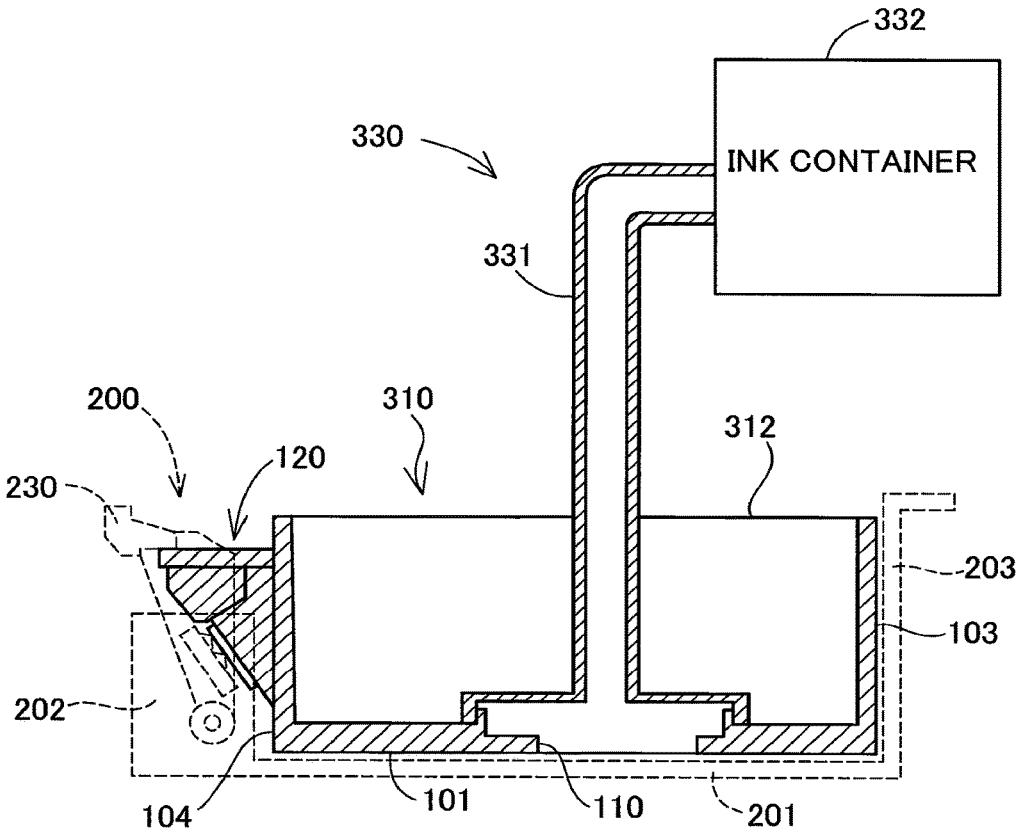
FIG. 27 is a schematic diagram illustrating the configuration of an ink supply unit according to a fifth embodiment.

FIG. 27 is a schematic diagram illustrating the configuration of a liquid supply unit 330 according to a fifth embodiment of the invention. The like components in FIG. 27 to those described in the first embodiment are expressed by the like numerical symbols. The liquid supply unit 330 of the fifth embodiment is attachable to and detachable from the printing device 10 described in the first embodiment as shown in FIGS. 1 and 2 and is attached to supply ink to the carriage 27 of the printing device 10. The liquid supply unit 330 of the fifth embodiment has an adaptor structure 310, an ink supply tube 331 and an ink container 332.

The adaptor structure 310 is similar to the adaptor structure 310 described in the fourth embodiment and has a main engagement part 120 and a circuit substrate 130 on the front or fourth wall 104 and an ink supply port 110 on the bottom or first wall 101. The ink container 332 is a liquid container internally having an ink chamber configured to contain ink. The ink chamber of the ink container 332 is connected with the ink supply port 110 of the adaptor structure 310 via the ink supply tube 331. The presence of the main engagement part 120 enhances the attachment of the liquid supply unit 330 of the fifth embodiment to the printing device 10. The liquid supply unit 330 of the fifth embodiment has the similar functions and advantageous effects to those of the first and the second ink cartridges 100*a* and 100*b* of the first embodiment.

F. Modifications

F1. Modification 1

In the circuit substrate 130 of the first and the second ink cartridges 100*a* and 100*b* of the first embodiment described above, the contact portions CP of the plurality of terminals 151 to 159 are divided into two lines, i.e., upper line and lower line and are arrayed in the array direction parallel to the direction of the arrow X. In the circuit substrate 130, however, it is not essential that all the contact portions CP of the respective terminals 151 to 159 are arrayed in the specific array direction. In the circuit substrate 130, it is only required that the contact portions CP of at least the first and the second terminals 151 and 152 out of the contact portions CP of the respective terminals 151 to 159 should be arrayed in one specific array direction. In this modification, the specific array direction is not necessarily the direction parallel to the direction of the arrow X but may be a direction inclined to the direction of the arrow X. In the first embodiment described above, the respective terminals 151 to 159 have similar array configuration to the array configuration of their respective contact portions CP. The respective terminals 151 to 159 may, however, not have similar array configuration to the array configuration of their respective contact portions CP. For example, while the respective adjacent contact portions CP may be arrayed linearly, the respective adjacent terminals 151 to 159 may be offset vertically to be arranged in zigzag. In the first embodiment described above, the contact portion CP is provided at the substantially middle position in each of the terminals 151 to 159. The contact portion CP of each of the terminals 151 to 159 may, however, be provided at a different position, for example, a position near to some side or a position near to some corner, in each of the terminals 151 to 159. The respective terminals 151 to 159 are not limited to the approximately rectangular shape but may be in any of various other shapes.

F2. Modification 2

In the first embodiment described above, in the state that the first and the second ink cartridges 100*a* and 100*b* are attached to the holder structure 200, the center of the main engagement part 120 in the direction of the arrow X is located at substantially the same position as the center of the lever member 230 in the direction of the arrow X. The center of the main engagement part 120 in the direction of the arrow X may, however, be located at a position shifted from the center of the lever member 230 in the direction of the arrow X. In the above first embodiment, in the state that the first and the second ink cartridges 100*a* and 100*b* are attached to the holder structure 200, the main engagement part 120 is entirely located below the bridging section 232 of the lever member 230 in the view in the direction of the arrow Z. The main engagement part 120 may, however, be partly or entirely located at a position shifted from that below the bridging section 232 of the lever member 230 in the view in the direction of the arrow Z. The main engagement part 120 having the sufficient width in the array direction of the first and the second terminals 151 and 152 to be greater than the interval between the first and the second terminals 151 and 152 enhances the attachment of the first and the second ink cartridges 100*a* and 100*b* to the holder structure 200.

F3. Modification 3

In the first embodiment described above, the main engagement part 120 comes into contact at the two brim sections 121 and 123 with the flat plate part 236 of the bridging section 232 of the lever member 230. In the second embodiment described above, the main engagement part 120A comes into contact at the two convexes 124*t* with the flat plate part 236 of the bridging section 232 of the lever member 230. The structure of the main engagement part of the liquid supply unit is, however, not limited to the structures of the main engagement parts 120 and 120A but may be any other structure. For example, in the main engagement part 120 of the first embodiment, the cut 122 may be omitted. In the main engagement part 120A of the second embodiment, a plurality of convexes 124*t* may additionally be provided on the brim section 124. In the main engagement parts 120 and 120A, the width between both ends of the abutting area which comes into contact with the engaged part should be wider than the interval between the contact portions CP of the first and the second terminals 151 and 152 in the array direction of the first and the second terminals 151 and 152.

F4. Modification 4

In the first embodiment describe above, the first and the second ink cartridges 100*a* and 100*b* are provided as ink containers in the approximately rectangular parallelepiped shape and are configured to have the six walls 101 to 106. The first and the second ink cartridges 100*a* and 100*b* may, however, not be in the approximately rectangular parallelepiped shape and may not have all the six walls 101 to 106. Each of the first and the second ink cartridges 100*a* and 100*b* may be formed, for example, as a hexahedron in an approximately trapezoidal shape viewed in the direction of the arrow X (in the side view) or as an approximately circular disk in an approximately elliptical shape in the side view. Each of the walls 101 to 106 defining the outer shape of each of the first and the second ink cartridges 100*a* and 100*b* may not have a flat surface or a smooth surface but may have some concavo-convex shape. Each of the walls 101 to 106 may not be extended as a planar surface but may have some cut or crack. Each of the walls 101 to 106 may be bent to have a substantially curved surface. Additionally, the respective walls 101 to 106 may have flexibility and may be provided as a frame to hold a bag-like member containing ink.

F5. Modification 5

In the first embodiment described above, in the front view of the fourth wall 104 as shown in FIGS. 7 and 21, the array direction of the brim sections 121 and 123 of the main engagement part 120 is identical with the array direction of the contact portions CP of the first and the second terminals 151 and 152 on the circuit substrate 130. The array direction of the brim sections 121 and 123 of the main engagement part 120 may be, however, different from the array direction of the contact portions CP of the first and the second terminals 151 and 152 on the circuit substrate 130.

F6. Modification 6

In the first embodiment described above, the main engagement part 120 and the circuit substrate 130 are provided on the fourth wall 104, which is arranged to face the user in the state that the first or the second ink cartridge 100*a* or 100*b* is attached to the printing device 10. The main engagement part 120 and the circuit substrate 130 may, however, be provided in any suitable part other than the fourth wall 104. For example, the main engagement part 120 and the circuit substrate 130 may be provided in the third wall 103.

F7. Modification 7

In the first embodiment described above, the first and the second ink cartridges 100*a* and 100*b* are attached to the printing device 10 via the holder structure 200 having the lever member 230 as the engaged part which is to be engaged with the main engagement part 120. The first and the second ink cartridges 100*a* and 100*b* may, however, be attached to the printing device 10 via a holder structure having an engaged part of different structure from the structure of the lever 230. For example, the main engagement part 120 of each of the first and the second ink cartridges 100*a* and 100*b* may be engaged with an engaged part without a rotating mechanism or may be engaged with a stepped surface provided on the inner wall surface of the holder structure and extended in the direction of the arrow X.

F8. Modification 8

In the first embodiment described above, the first and the second terminals 151 and 152 are used for detection of the state of attachment of the first and the second ink cartridges 100*a* and 100*b* to the holder structure 200. The first and the second terminals 151 and 152 may, however, be used for a different purpose other than detection of the state of attachment of the first and the second ink cartridges 100*a* and 100*b*. For example, each of the first and the second terminals 151 and 152 may be used as a power terminal or as a ground terminal or may be used for communication of data signals. In the circuit substrate 130 of the above first embodiment, the terminals 153 to 159, i.e., the terminals other than the first and the second terminals 151 and 152, may be omitted. Even in such modification, the first and the second terminals 151 and 152 may also be used for the purpose other than detection of the state of attachment of the first and the second ink cartridges 100*a* and 100*b*.

F9. Modification 9

In the first embodiment described above, each of the first and the second ink cartridges 100*a* and 100*b* is attached to the holder structure 200 along the locus of rotating motion about the upper edge of the third wall 103 as the supporting point as shown in FIGS. 19 and 20. Each of the first and the second ink cartridges 100*a* and 100*b* may, however, not be attached to the holder structure 200 along the locus of rotating motion about the upper edge of the third wall 103 as the supporting point. For example, each of the first and the second ink cartridges 100*a* and 100*b* may be attached to the holder structure 200 downward along the linear locus.

F10. Modification 10

In the first embodiment described above, in the course of attachment of the first or the second ink cartridge 100*a* or 100*b*, the first side wall portion 125 and the second side wall portion 126 of the main engagement part 120 come into contact with the lever member 230 to move the lever member 230 forward as shown in section (c) of FIG. 20. The first side wall portion 125 and the second side wall portion 126 of the main engagement part 120 may, however, be arranged not to come into contact with the lever member 230 in the course of attachment of the first or the second ink cartridge 100*a* or 100*b*. The first side wall portion 125 and the second side wall portion 126 may be provided only for the purpose of protecting the terminal assembly 131 of the circuit substrate 130. Either one or both of the first side wall portion 125 and the second side wall portion 126 of the main engagement part 120 may be omitted.

F11. Modification 11 in the first embodiment described above, the extended section 113 from the cover member constituting the second wall 102 is extended to the rear face side of the main engagement part 120 and forms part of the main engagement part 120. The extended section 113 may be extended farther forward to form the brim sections 121 and 123 of the main engagement part 120.

F12. Modification 12

In the first embodiment described above, the first and the second ink cartridges 100*a* and 100*b* are pressed upward by the pressing mechanism 217 of the holder structure 200 when being attached to the holder structure 200. The pressing mechanism 217 of the holder structure 200 may, however, be omitted, and the first and the second ink cartridges 100*a* and 100*b* may not be pressed upward when being attached to the holder structure 200.

F13. Modification 13

In the first embodiment described above, the lever member 230 of the holder structure 200 is pressed by the pressing mechanism. The lever member 230 may, however, not be pressed, and the pressing mechanism of the lever member 230 may be omitted. In this modification, the lever 230 may be rotated an moved by the user's finger operation in the course of attachment of each of the first and the second ink cartridges 100*a* and 100*b*.

F14. Modification 14

In the first embodiment described above, the first and the second ink cartridges 100*a* and 100*b* are attached to the printing device 10. A single cartridge produced by integrating the first and the second ink cartridges 100*a* and 100*b* may be attached to the printing device 10. A plurality of ink cartridges, each having a single ink chamber, like the first ink cartridge 100*a*, may be attached to the printing device 10. A plurality of ink cartridges, each having a plurality of ink chambers, like the second ink cartridge 100*b*, may be attached to the printing device 10.

F15. Modification 15

The above respective embodiments and modifications describe the ink supply units such as the first and the second ink cartridges 100*a* and 100*b* attached to the printing device 10 having the liquid ejection mechanism of ejecting ink, as the liquid supply units of the invention. The liquid supply unit of the invention may be configured as a supply unit of a different liquid other than ink. For example, the liquid supply unit of the invention may be configured as a water supply unit attached to a high-pressure cleaning machine which sprays a liquid such as water onto an object to be cleaned and cleans the object, to supply water.

F16. Modification 16

As described in the above first embodiment, the first and the second terminals 151 and 152 have the similar functions to those of the fifth and the sixth terminals 155 and 156. Accordingly, the description regarding the relationship between the first and the second terminals 151 and 152 and another component of the first or the second ink cartridge 100*a* or 100*b* or another component of the holder structure 200 in the above respective embodiments and modifications can be interpreted with replacement of the first and the second terminals 151 and 152 with the fifth and the sixth terminals 155 and 156. More specifically, such description may be interpreted on the assumption that the fifth terminal 155 and the sixth terminal 156 respectively correspond to the first detection terminal having the first contact portion and the second detection terminal having the second contact portion. This modified configuration provides the functions and advantageous effects similar to those described in the first embodiment.

The invention is not limited to any of the embodiments, the examples and the modifications described herein but may be implemented by a diversity of other configurations without departing from the scope of the invention. For example, the technical features of the embodiments, examples or modifications corresponding to the technical features of the respective aspects described in Summary may be replaced or combined appropriately, in order to solve part or all of the problems described above or in order to achieve part or all of the advantageous effects described above. Any of the technical features may be omitted appropriately unless the technical feature is described as essential herein.

What is claimed is:

1. A liquid supply unit configured to be attachable to and detachable from a liquid ejection device that comprises an electrode assembly and an engaged part, the liquid supply unit comprising:

a lower wall having a liquid supply port;

an upper wall opposed to the lower wall;

a first vertical wall intersecting the lower wall and the upper wall;

a second vertical wall intersecting the lower wall and the upper wall and opposed to the first vertical wall;

a third vertical wall intersecting the lower wall, the upper wall, the first vertical wall and the second vertical wall;

a fourth vertical wall intersecting the lower wall, the upper wall, the first vertical wall and the second vertical wall and opposed to the third vertical wall;

an inclined surface extending outward and upward from the second vertical wall such that the second vertical wall has a vertically extending section below the inclined surface;

a plurality of contact portions arrayed in an array direction on the inclined surface, the contact portions being electrically connectable with the electrode assembly; and an engagement part that is engageable with the engaged part, wherein the engagement part is located above the inclined surface on the second vertical wall.

2. The liquid supply unit according to claim 1, wherein:

the plurality of contact portions includes a first contact portion and a second contact portion located on both ends in the array direction, and a width of the engagement part is greater than a distance between the first contact portion and the second contact portion in the array direction.

3. The liquid supply unit according to claim 2, wherein:

in a plan view of the liquid supply unit in a direction from the second vertical wall toward the first vertical wall, the first contact portion and the second contact portion are located between the engagement part and the lower wall.

4. The liquid supply unit according to claim 2, wherein:

in a plan view of the liquid supply unit in a direction from the second vertical wall toward the first vertical wall, a distance from the third vertical wall to the engagement part is shorter than a distance from the third vertical wall to the first contact portion, and a distance from the fourth vertical wall to the second part is shorter than a distance from the fourth vertical wall to the second contact portion.

5. The liquid supply unit according to claim 1, wherein:

the liquid supply unit is configured to be rotated about an abutting position where the first vertical wall abuts against the liquid ejection device, as a supporting point, so as to be attached to the liquid ejection device.

6. The liquid supply unit according to claim 1, wherein:

the engagement part comprises a first part, a cut, and a second part arranged sequentially in a direction from the third vertical wall toward the fourth vertical wall, and the first part and the second part are configured to abut against the engaged part in a direction from the lower wall toward the upper wall while the liquid supply unit is attached to the liquid ejection device.

* * * * *